US011821191B2

(12) United States Patent
Lai et al.

(10) Patent No.: US 11,821,191 B2
(45) Date of Patent: Nov. 21, 2023

(54) EXTENDED-TIME RELEASE METHOD AND DEVICE FOR TOILET CLEANER

(71) Applicant: Guangzhou Blue Moon Industrial Co., Ltd., Guangdong (CN)

(72) Inventors: Zhanqiu Lai, Guangdong (CN); Lili Hu, Guangdong (CN); Cancan Wang, Guangdong (CN)

(73) Assignee: GUANGZHOU BLUE MOON INDUSTRIAL CO., LTD., Guangdong (CN)

( * ) Notice: Subject to any disclaimer, the term of this patent is extended or adjusted under 35 U.S.C. 154(b) by 50 days.

(21) Appl. No.: 17/338,258

(22) Filed: Jun. 3, 2021

(65) Prior Publication Data

US 2021/0293012 A1 Sep. 23, 2021

Related U.S. Application Data

(63) Continuation of application No. PCT/CN2020/077526, filed on Mar. 3, 2020.

(30) Foreign Application Priority Data

| | | |
|---|---|---|
| Apr. 25, 2019 | (CN) | 201910339454.4 |
| Apr. 25, 2019 | (CN) | 201910339489.8 |
| Apr. 25, 2019 | (CN) | 201910340269.7 |
| Dec. 4, 2019 | (CN) | 201911228402.6 |

(Continued)

(51) Int. Cl.
*E03D 9/03* (2006.01)
*E03D 9/02* (2006.01)

(52) U.S. Cl.
CPC ..... *E03D 9/032* (2013.01); *E03D 2009/024* (2013.01)

(58) Field of Classification Search
CPC ..... E03D 9/032; E03D 9/0022; E03D 9/005; E03D 2009/024
USPC ..... 4/223
See application file for complete search history.

(56) References Cited

U.S. PATENT DOCUMENTS

| | | | | |
|---|---|---|---|---|
| 6,311,340 | B1 * | 11/2001 | Thompson | E03D 9/032 4/231 |
| 2002/0083514 | A1 * | 7/2002 | Lhoste | E03D 9/032 4/231 |
| 2004/0172741 | A1 | 9/2004 | Troost | |
| 2008/0303186 | A1 | 12/2008 | Lu | |

(Continued)

FOREIGN PATENT DOCUMENTS

| | | |
|---|---|---|
| CN | 1250837 A | 4/2000 |
| CN | 1355866 A | 6/2002 |

(Continued)

*Primary Examiner* — Huyen D Le
(74) *Attorney, Agent, or Firm* — Muncy, Geissler, Olds & Lowe, P.C.

(57) ABSTRACT

A extended-time release method includes the following steps: mixing water with the toilet cleaner to form an initial solution when water enters a bowl; starting release of the initial solution while water level in the bowl returns to normal; and continuing release of the initial solution after the water level in the bowl returns to normal, in which a mixed liquid of the initial solution and the water in the bowl is referred to as a primary solution; in the above method, the volume of the initial solution is not less than 10 ml; and the content of the effective ingredients of the toilet cleaner in the primary solution is not less than 2 ppm.

15 Claims, 17 Drawing Sheets

(30) Foreign Application Priority Data

Dec. 4, 2019 (CN) ..... 201911229742.0
Dec. 4, 2019 (CN) ..... 201911229853.1

(56) References Cited

U.S. PATENT DOCUMENTS

2011/0138526 A1* 6/2011 Hsu ..... E03D 9/03
4/223
2012/0047640 A1* 3/2012 Warkotsch ..... C11D 17/0056
510/192
2013/0112830 A1* 5/2013 Knorr ..... E03D 9/032
248/304

FOREIGN PATENT DOCUMENTS

| | | | |
|---|---|---|---|
| CN | 1788564 | A | 6/2006 |
| CN | 1946908 | A | 4/2007 |
| CN | 101405382 | A | 4/2009 |
| CN | 102421885 | A | 4/2012 |
| CN | 204266335 | U | 4/2015 |
| CN | 208777401 | U | 4/2019 |
| CN | 110820881 | A | 2/2020 |

* cited by examiner

| Samples | Sample one | Sample two | Sample three | Sample four | Sample five | | | | | |
|---|---|---|---|---|---|---|---|---|---|---|
| Composition of toilet cleaner | 1-bromo-3-chloro-5,5-dimethyl hydantoin (BCDMH) | A mixture of 1-bromo-3-chloro-5,5-dimethylhydantoin, 1,3-dichloro-5,5-dimethylhydantoin, 1,3-dichloro-5-methyl-5-ethylhydantoin (in which 1-bromo-3-chloro-5,5-dimethylhydantoin content is 60%, 1,3-dichloro-5,5-dimethylhydantoin content is 28%, 1,3-dichloro-5-methyl-5-ethylhydantoin content is 11%, and impurities content is 1%) | A mixture of 1-bromo-3-chloro-5,5-dimethylhydantoin, 1,3-dichloro-5,5-dimethylhydantoin, 1,3-dichloro-5-methyl-5-ethylhydantoin (in which 1-bromo-3-chloro-5,5-dimethylhydantoin content is 60%, 1,3-dichloro-5,5-dimethylhydantoin content is 28%, 1,3-dichloro-5-methyl-5-ethylhydantoin content is 11%, and impurities content is 1%) | 1,3-Dichloro-5,5-dimethylh ydantoin (DCDMH ) | A mixture of 1-bromo-3-chloro-5,5-dimethylhydantoin, 1,3-dichloro-5,5-dimethylhydantoin, 1,3-dichloro-5-methyl-5-ethylhydantoin (in which 1-bromo-3-chloro-5,5-dimethylhydantoin content is 60%, 1,3-dichloro-5,5-dimethylhydantoin content is 28%, 1,3-dichloro-5-methyl-5-ethylhydantoin content is 11%, and impurities content is 1%) | | | | | |
| Form of toilet cleaner | Granular | Block | Granular | Granular | Gran ular | Granul ar | Granul ar | Granul ar | Granul ar | Granul ar |
| Usage amount (g) of toilet cleaner | 5 | 13 | 5 | 5 | 5 | 5 | 5 | 3 | 3 | 3 |
| Volume of water accumulated in package (mL) | 60 | 60 | 60 | 60 | 35 | 42 | 55 | 30 | 20 | 20 |

FIG. 20

| | | | | | | | | | | | |
|---|---|---|---|---|---|---|---|---|---|---|---|
| Whether water is stored or not; storage water volume (mL) if water is stored | | 30 | 30 | 30 | 30 | NO | NO | NO | NO | NO | NO |
| Water release time (min) | | 4 | 4 | 4 | 4 | 7.5 | 7.5 | 7.5 | 5 | 10 | 5 |
| Effective chlorine concentration (ppm) in water body of bowl | Day 1 | 4.97 | 10.31 | 19.75 | 3.80 | 31.00 | 17.60 | 19.34 | 6.70 | 5.83 | 6.24 |
| | Day 2 | 3.78 | 7.64 | 10.29 | 2.95 | 20.79 | 18.25 | 21.86 | 7.78 | 6.20 | 6.79 |
| | Day 3 | 4.69 | 8.56 | 9.44 | 4.58 | 19.53 | 14.90 | 17.15 | 4.46 | 4.74 | 3.77 |
| | Day 4 | 4.87 | 5.95 | 7.13 | 3.60 | 13.13 | 10.09 | 11.29 | 6.11 | 5.06 | 4.03 |
| | Day 5 | 4.74 | 8.81 | 7.13 | 4.62 | 9.20 | 13.26 | 8.15 | 4.30 | 3.52 | 3.36 |
| | Day 6 | 4.52 | 8.02 | 5.65 | 3.92 | 5.93 | 7.58 | 8.04 | 2.92 | 3.56 | 3.12 |
| | Day 7 | 5.26 | 7.88 | 6.61 | 4.03 | 4.86 | 5.47 | 5.37 | 3.29 | 3.03 | 2.90 |
| | Day 8 | 4.13 | 6.71 | 5.57 | 4.52 | 6.77 | 8.77 | 7.29 | 3.14 | 2.79 | 2.19 |
| | Day 9 | 4.27 | 6.15 | 6.32 | 4.08 | 6.64 | 5.48 | 5.05 | 2.75 | 2.40 | 2.05 |
| | Day10 | 4.25 | 7.11 | 6.73 | 3.68 | 4.82 | 8.24 | 3.26 | 2.83 | 2.57 | 1.91 |
| | Day11 | 4.46 | 7.27 | 5.90 | 4.69 | 6.19 | 7.05 | 7.22 | 2.92 | 3.36 | 1.89 |
| | Day 12 | 3.67 | 6.46 | 5.80 | 8.20 | 6.45 | 7.68 | 5.17 | 3.52 | 3.47 | 1.99 |
| | Day 13 | 3.30 | 5.56 | 5.84 | 3.78 | 4.73 | 4.52 | 6.94 | 2.65 | 2.11 | 2.36 |

FIG. 20 (Continued)

| | | | | | | | | | | | |
|---|---|---|---|---|---|---|---|---|---|---|---|
| | Day 14 | 3.66 | 6.16 | 6.70 | 4.36 | 6.48 | 6.11 | 4.34 | 3.70 | 2.91 | 3.62 |
| | Day 15 | 3.40 | 7.42 | 6.50 | 5.18 | 6.04 | 7.29 | 5.71 | 3.19 | 3.13 | 2.75 |
| | Day 16 | 3.54 | 5.98 | 3.96 | 4.53 | 4.80 | 7.48 | 6.83 | 7.89 | 5.35 | 7.04 |
| | Day 17 | 4.12 | 5.40 | 4.52 | 3.83 | 4.08 | 5.62 | 7.09 | 3.75 | 1.97 | 2.98 |
| | Day 18 | 3.85 | 6.21 | 4.46 | 3.69 | 5.46 | 3.98 | 6.16 | 2.92 | 2.96 | 2.64 |
| | Day 19 | 3.88 | 5.84 | 4.83 | 3.47 | 4.79 | 4.52 | 4.37 | 3.02 | 2.69 | 2.46 |
| | Day 20 | 4.23 | 5.41 | 5.20 | 3.39 | 4.15 | 3.86 | 5.49 | 3.13 | 2.22 | 2.86 |
| | Day 21 | 3.57 | 5.82 | 4.71 | 2.52 | 6.52 | 5.72 | 5.14 | 3.04 | 2.38 | 2.03 |
| | Day 22 | 3.55 | 5.73 | 4.19 | 3.24 | 4.29 | 4.94 | 5.43 | 3.55 | 2.65 | 2.66 |
| | Day 23 | 3.52 | 5.51 | 4.86 | 3.33 | 3.58 | 6.53 | 5.01 | 3.40 | 2.88 | 2.38 |
| | Day 24 | 3.46 | 6.92 | 4.92 | 3.07 | 4.23 | 5.03 | 8.44 | 2.77 | 2.38 | 2.79 |
| | Day 25 | 3.03 | 6.04 | 3.58 | 3.21 | 2.28 | 4.11 | 7.16 | 3.21 | 3.01 | 3.21 |
| | Day 26 | 3.85 | 6.18 | 4.48 | 3.41 | 2.22 | 4.62 | 4.86 | 3.26 | 3.06 | 3.43 |

FIG. 20 (Continued)

| | | | | | | | | | | | |
|---|---|---|---|---|---|---|---|---|---|---|---|
| | Day 27 | 3.19 | 6.84 | 4.26 | 4.31 | | | | 3.15 | 2.31 | 2.66 |
| | Day 28 | 3.79 | 5.79 | 4.10 | | | | | 2.82 | 2.39 | 2.41 |
| | Day 29 | 3.44 | 5.97 | 3.90 | | | | | 2.64 | 2.67 | 2.20 |
| | Day 30 | 3.28 | 4.83 | 2.85 | | | | | 3.10 | 2.30 | 2.80 |
| Times of flush per day for flushing | | Flush 6 times per day | Flush 6 times per day | Flush 6 times per day | Flush 6 times per day | Flush 6 times per day | Flush 6 times per day | Flush 6 times per day | Flush 10 times per day | Flush 10 times per day | Flush 10 times per day |

FIG. 20 (Continued)

| | | |
|---|---|---|
| Search in CNKI Database | 1,3-dichloro-5,5-dimethylhydantoin | Solubility is 1.98 g/L at 20 °C |
| | 1,3-dibromo-5,5-dimethylhydantoin | Solubility: 1 L of water dissolves 2.2 g of dibromohydantoin at 20 °C of water temperature |
| | 1-bromo-3-chloro-5,5-dimethylhydantoin | Solubility: 1 L of water dissolves 2.5 g of dibromohydantoin at 20 °C of water temperature |
| Search in SciFinder Academic (American Chemical Abstracts Database) | 1,3-dichloro-5,5-dimethylhydantoin | Solubility is 1.4 g/L at 25 °C |
| | 1,3-dibromo-5,5-dimethylhydantoin | Solubility is 5.4 g/L at 25 °C |
| | 1-bromo-3-chloro-5,5-dimethylhydantoin | Solubility is 7.2 g/L at 25 °C |
| | 1-chloro-3-bromo-5,5-dimethylhydantoin | Solubility is 7.2 g/L at 25 °C |
| | 1,3-dichloro-5-methyl-5-ethylhydantoin | Solubility is 0.63 g/L at 25 °C |
| | 1,3-dibromo-5-methyl-5-ethylhydantoin | Solubility is 2.5 g/L at 25 °C |
| | 3-bromo-1-chloro-5-methyl-5-ethylhydantoin | Solubility is 3.3 g/L at 25 °C |
| | 1-bromo-3-chloro-5-methyl-5-ethylhydantoin | Solubility is 3.3 g/L at 25 °C |

FIG. 21

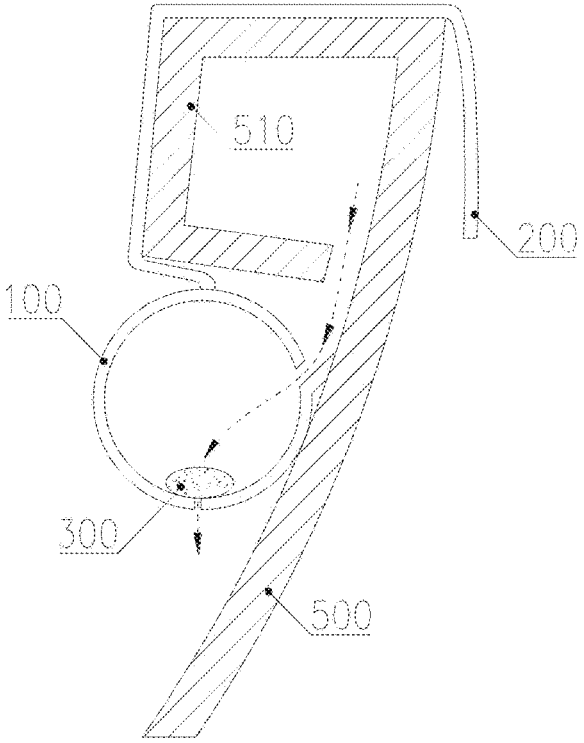

FIG. 22

EXTENDED-TIME RELEASE METHOD AND DEVICE FOR TOILET CLEANER

CROSS REFERENCE TO RELATED APPLICATIONS

The present application is a continuation of International Application No. PCT/CN2020/077526, filed on Mar. 3, 2020, which claims priorities from Chinese Patent Application No. 201910339454.4 filed on Apr. 25, 2019, Chinese patent Application No. 201910339489.8 filed on Apr. 25, 2019, Chinese patent Application No. 201910340269.7 filed on Apr. 25, 2019, Chinese patent Application No. 201911229853.1 filed on Dec. 4, 2019, Chinese patent Application No. 201911228402.6 filed on Dec. 4, 2019, and Chinese patent Application No. 201911229742.0 filed on Dec. 4, 2019, all of which are hereby incorporated herein by reference.

TECHNICAL FIELD

The present invention relates to the technical field of toilet cleaner placement, and specifically to an extended-time release method and device for a toilet cleaner.

BACKGROUND ART

Whether at home or in a public health area, it is necessary to clean and deodorize flush toilets to ensure sanitation of the flush toilets and environmental hygiene. Common treatment methods can be divided into two methods. The first method is to place effective substances, such as a cleaner or fragrance, in a flush toilet tank to be gradually dissolved in the water tank. When the toilet flushes, water with the effective substances enters the toilet from the water tank to flush the inner wall of the toilet to achieve cleanliness, and the effective substances remaining in the water inside the toilet emit fragrance and improve the environment. The second method is to directly attach the effective substances, such as solid blocks or gel-like pastes, to the inside of the toilet. When water in the water tank enters the toilet, the water flushes the inner wall of the toilet while flushing the solid blocks or gel-like substances so as to achieve the purpose of cleaning or deodorizing. The above two methods require manual placement or a replacement of new effective substances in a short period of time to achieve continuous treatment of the flush toilet. During manual operation, some corrosive or easily-stained substances may smudge the hands and bring users inconvenience or even harm.

For the first commonly used treatment method, the effective substances are soaked in water in the water tank for a long time and are in a constant dissolved state regardless of whether the toilet is used, which causes accelerated dissolution of the effective substances. Moreover, when the dissolved water in the water tank is used to flush the inner wall of the toilet, a large amount of dissolved water flows away from the sewer while only a small part of dissolved water remains within the toilet. In brief, the effective substances have a short service life, which is unrelated to the number of uses of the toilet, and thus most of the effective substances are wasted.

For the second commonly used treatment method, in order to prevent large pieces of effective substances from being washed away, the dissolution rate of solid substances is often slow. When the water in the water tank flows through the effective substances attached on the inner wall of the toilet, the effective ingredients in the obtained dissolved water are insufficient, most of which may also enter the sewer while the amount left in the toilet is rather small, thereby causing waste. On the other hand, the concentration of effective substances in the dissolved water is extremely low, which cannot achieve the desired effects of cleanliness and deodorization.

Therefore, the existing means of cleaning and deodorizing the flush toilet have the deficiencies of excessive, or insufficient, or uneven release of the effective substances, or huge loss of the effective substances, which cause waste and are far from the ideal effect.

SUMMARY

The present invention aims to overcome at least one of the deficiencies in the prior art described above, and provides an extended-time release method for a toilet cleaner, which can prevent the effective ingredients in the toilet cleaner from being quickly washed away by water flows, thereby ensuring the content of effective substances of the toilet cleaner in the toilet, causing most of the solution to remain in the toilet, reducing the waste, and improving practical effects.

Another object of the present invention is to provide an extended-time release device for a toilet cleaner, so that the toilet cleaner placed in a housing can be released for a longer time and most of the solution remains in the toilet, which ensures the content of the effective substances of the toilet cleaner in the toilet, reducing the waste, and improving a using effect.

An extended-time release method for a toilet cleaner, which acts on inside of a toilet bowl, and the method includes the following steps: mixing water with the toilet cleaner to form an initial solution when water enters a bowl; starting release of the initial solution while water level in the bowl returns to normal; and continuing the release of the initial solution after the water level in the bowl returns to normal until the release ends or some residual liquid remains, in which a mixed liquid of the initial solution and the water in the bowl is referred to as a primary solution.

The method according to the present invention mainly acts on a flush toilet, more specifically, the bowl of the flush toilet. The bowl is connected with a sewer through a U-shaped pipe, so that the bowl and the U-shaped pipe tend to have the same composition of water in the end after the user flushes the toilet every time. In addition, most of the toilets are provided with a water replenishing pipe, which is used to directly introduce water into the bowl in order to keep the water level of the bowl stable while in a process of discharging the water in a toilet tank and recovering the water level in the tank, so that the water level in the bowl may not be changed due to the inertia effect of water drainage in the bowl, and the water replenishing of the bowl and the toilet tank is completed at the same time. In addition, the volume of the initial solution formed by the dissolved toilet cleaner in the bowl according to the present invention is rather small relative to the volume of water stored in the bowl. When water replenishing is stopped in the bowl or the toilet tank, the influence of the release of the initial solution on the water level in the bowl is negligible, which can be assumed that stopping the water replenishing in the bowl or the toilet tank is equivalent to that the water level in the bowl returns to normal. For a toilet without a water replenishing pipe, it can be assumed that the water level in the bowl returns to normal as long as the water level in the toilet bowl does not rise obviously in the end. When using the present technical solution, the toilet cleaner is fixed to an inner wall of the bowl, a flush valve in the tank opens when a user presses a push button on the flush toilet, and the water in the tank enters the bowl via rim holes of the bowl. According to different water flushing directions in the bowl, the flush toilet can be roughly divided into two types, that is, a flush toilet with a vertically flushed bowl or a flush toilet with a horizontally flushed bowl. Regardless of the structure of the flush toilet, water is required to be mixed with the toilet cleaner. Herein, the toilet cleaner can be granular and packaged in a water-permeable bag, such as a non-woven bag. After the water and the toilet cleaner are mixed, the initial solution can be formed. As the mixing time increases, the content of effective solutes of the toilet cleaner in the initial solution becomes higher and higher; the later the initial solution is released, the higher the solute content is contained in the initial solution. In addition, when it is needed to dissolve the toilet cleaner for a certain period of time to form an initial solution with a higher concentration so as to be released later; this can be achieved by controlling a dissolution rate or a homogeneous mixing rate of the toilet cleaner.

When the initial solution of begins to be released, the water level in the bowl gradually rises and finally returns to normal when water level is in a unflushed state, the water surface in the bowl gradually calms at the same time, and then the initial solution continues the release for a period of time until the release of the initial solution formed by mixing the water and the toilet cleaner is completed. In this stage, a time period between a time point when the water level in the bowl returns to normal and a time point when release of the initial solution is completed is referred to as an extended release time of the toilet cleaner. By controlling the dissolution rate of the initial solution, the time required for dissolution is appropriately extended, so that an amount of solute of the toilet cleaner that is dissolved and washed away at an initial stage of flushing is reduced. Moreover, when the volume of the initial solution is constant, an extended release time causes a higher amount of solute of the toilet cleaner in the initial solution to remain in the bowl. In other words, the solution is prevented from being washed away by the water flow during flushing, so that a large amount of solution remains in the toilet, which reduces waste and ensures the concentration and using effect of the primary solution in the bowl.

Further, the toilet cleaner is provided in the housing. As to a case where water exists in the housing, before water enters the housing, the toilet cleaner forms an initial solution with a density $\rho 1$ in the housing; when water enters the housing again, the water dilutes the initial solution to become a replacement solution with a density $\rho 2$. The replacement solution slowly flows out of a side opening of the housing and enters the bowl.

Further, as to a case where water does not exist in the housing, the initial solution continues to be released after the water level of the bowl returns to normal until the release is completed, and the mixed liquid of the initial solution and water existing in the bowl is referred to as a primary solution.

Further, in the above method, the volume of the initial solution is not less than 10 ml; and the content of the effective ingredients of the toilet cleaner in the primary solution is not less than 2 ppm.

Further, the solubility of the toilet cleaner in the initial solution in water at 25° C. is not more than 10 g/L, or the solubility of the toilet cleaner in the initial solution in water at 20° C. is not more than 5 g/L.

Further, in the method, a time from the water entering the bowl to the water level in the bowl returning to normal is defined as a toilet flushing time $t1$; a time from the beginning of the release of the initial solution to the end of the release is defined as an initial solution outflow time $t3$; a time from the water level in the bowl returning to normal to the end of the release of the initial solution is defined as an initial solution partially extended release time $t4$; and $t4=t3-t1$. In actual use, the toilet cleaner is stored in a constant-volume container, so that the volume of water entering the container is constant. When the water level in the bowl does not return to normal, the concentration of the initial solution flowing into the bowl is low. As the water in the container becomes less and less, the time to dissolve or dilute the toilet cleaner becomes longer and longer, and the concentration of the initial solution flowing into the bowl becomes higher and higher, which can ensure that the final concentration of the initial solution flowing into the bowl is the highest after the water level in the bowl returns to normal, so that most of the effective substances of the toilet cleaner in the bowl remains in the toilet and the waste is reduced.

Further, the time from the water level in the bowl returning to normal to the end of the release of the initial solution is defined as the initial solution partially extended release time $t4$, then $t4 \geq 3$ minutes, and/or $t4 \geq t1$. After pressing and flushing an existing toilet on the market once, the time, from the water in the tank flowing out to the water surface in the toilet bowl becoming calm, $t1=5$ to 120 seconds. To increase the content of the initial solution remaining in the toilet bowl, that is, to increase the content of the solute in the primary solution, the initial solution should be released as late as possible after the water surface in the bowl becomes calm. In addition, as the service time of the flush toilet increases, a flush valve in the tank becomes loose and aging. After pressing and flushing the toilet once, the time of the water flowing from the tank into the bowl is significantly extended, that is, the time required for the water surface in the bowl to calm increases. Therefore, the initial solution is set to continue the release for at least another 3 minutes after the flushing is completed. In addition, when water starts to enter the bowl, the water is mixed with the toilet cleaner at the same time to form the initial solution and the release begins, so that a time period between the time when the initial solution starts the release to a starting time point of the extended release time $t4$ is basically the same as the toilet flushing time $t1$. To ensure that the content of the effective ingredients in the primary solution in the bowl is as much as possible after the release of the initial solution, $t4 \geq t1$ is set, that is, the initial solution extended release duration is not less than the toilet flushing time $t1$. In addition, the concentration of the initial solution becomes higher and higher as the time for dissolving the toilet cleaner increases, so that at least 50% of the initial solution remains in the bowl, that is, at least 50% of the content of the effective substances in the bowl can remain in the primary solution, and thus the solute of the toilet cleaner remains in the bowl as much as possible.

Further, the time from starting the release of the initial solution to completing the release is defined as the initial solution outflow time $t3$, then $t3 \leq 40$ minutes and/or $t3 \geq 2t1$. Since $t4=t3-t1$, $t1=5$ to 120 seconds, and $t4 \geq 3$ minutes, it is preferable that $t3=4$ to 25 minutes. According to the volume of the initial solution, the release rate of the initial solution is controlled to adjust the time for the initial solution to be completely released. Considering the frequency of use of the toilet in different occasions, the time from the beginning of the release of the initial solution to the end of the release is set to be 4 to 25 minutes, so that the initial solution can be fully released during two consecutive uses of the toilet, the solute contained in the primary solution each time entering the bowl is sufficient, and the using effect of the toilet cleaner is improved. In addition, since $t4=t3-t1$, $t4 \geq t1$, then $t3 \geq 2t1$, it is ensured that the initial solution extended release duration t4 is not less than the toilet flushing time t1. In addition, the concentration of the initial solution becomes higher and higher as the time for dissolving the toilet cleaner increases, so that at least 50% of the initial solution remains in the bowl, that is, at least 50% of the content of the effective substances in the bowl can remain in the primary solution, and thus the solute of the toilet cleaner remains in the bowl as much as possible.

Further, the relationship between the solute content m1 of the primary solution and the solute content m0 of the initial solution is: $m1/m0=0.5$ to 1.

Flush toilets of different sizes have bowls with different water storage volumes, but the volume of the initial solution formed by the same type of toilet cleaner within the time t2 is constant, that is, the solute content m0 of the initial solution is constant. It is the solute in the primary solution that actually takes effect in the bowl. To ensure the effect of the primary solution in the bowl, a ratio of solute content is used for measurement, that is, $m1/m0=0.5$ to 1, and preferably, $m1/m0=0.5$ or 0.6 or 0.7 or 0.8 or 0.9 or 1. Since the bowl is communicated with the U-shaped pipe, a little solute inevitably enters the U-shaped pipe, so that the ratio of m1/m0 is required to be above 0.5. The actual testing steps are as follows: choosing two identical toilets (toilet A and toilet B), cleaning the toilet tanks and the bowls, filling the toilet tanks with water, and the water level in the bowls returning to normal; mounting two identical housings (a and b) on the same position of the two toilets respectively, and the housing located at this position can receive the water flowing into the bowl from the toilet tank; putting the same solid toilet cleaner of the same mass containing cleaning ingredients M into housings a and b respectively; pressing a flush button of the toilet A, using a container to receive all the initial solution released by the housing a when the housing a mounted on the toilet A starts to release the initial solution, and measuring the mass of M in the initial solution received by the container, which is denoted as m0; pressing a flush button of the toilet B, and measuring the mass of M in the primary solution in the bowl, which is denoted as m1, and thus the ratio of m1/m0 is obtained. By means of obtaining a certain volume of the initial solution and the primary solution and using physical and chemical methods, such as drying, the corresponding volume of solute content in the initial solution and the primary solution is obtained, and the total volume of the solute content in the initial solution and the primary solution can be calculated back, that is, an actual ratio of m1 to m0 can be obtained, so as to adjust a mixing ratio of toilet cleaner and water and the release amount of the initial solution.

Further, the toilet cleaner is placed in the housing, water is introduced into the housing according to structural characteristics of the flush toilet and mixed with the toilet cleaner to form the initial solution.

According to the technical solution, the toilet cleaner is placed in a box body with the housing, and then the box body is fixed to the rim of the toilet bowl. To prevent the box body from influencing the user to use the toilet, the box body structure has a small size while the flushed water cannot smoothly flow into the housing, so that the water is required to be introduced into the housing and mixed with the toilet cleaner to form the initial solution.

Further, when the bowl is flushed with vertical water flows and no water enters the housing, the toilet cleaner is located at the bottom within the housing under the effect of self-weight, the water is diverted to move obliquely downwards and diverted from the upper portion of the housing to dissolve or dilute the toilet cleaner, and the formed initial solution flows out of the housing.

When the bowl is flushed with vertical water flows, that is, the water from the flush toilet tank into the bowl flows downward into the bowl along the inner wall of the bowl. Since the water flows downward along the inner wall, an water inlet of the housing is provided on the upper portion and faces the inner wall of the bowl, the water flow is diverted downward from the inner wall into the housing leaning on the inner wall, so that the water is mixed with the toilet cleaner at the bottom within the housing to dissolve or dilute the toilet cleaner. As the amount of water entering the housing increases, the housing is filled with water while the toilet cleaner either floats in the housing or continues to be located at the bottom within the housing, which may eventually form the initial solution to flow out of the housing. In this process, by providing a slender diversion tube or opening a long and narrow water outlet channel on the housing, the initial solution is slowly released under the action of liquid tension, so that the effect of time extension is achieved.

Further, when the bowl is flushed with horizontal water flows and no water enters the housing, the toilet cleaner is located at the bottom within the housing under the effect of self-weight, the water is diverted to move obliquely upwards and diverted from the upper portion of the housing, so that the water is mixed with the toilet cleaner at the bottom within the housing to dissolve or dilute the toilet cleaner, and the formed initial solution flows out of the housing.

When the bowl is flushed with horizontal water flows, that is, the water in the flush toilet tank enters the bowl from 1 to 2 horizontally arranged water outlets in the rim of the bowl. When flushing the toilet, the water may rush out horizontally and form a swirl along the wall of bowl under the action of gravity, which increases the washing power of the water flow on the wall of the bowl. Therefore, the horizontally rushed out water flow enters the housing by adopting the obliquely upward diversion method. As the amount of water entering the housing increases, the housing is filled with water while the toilet cleaner either floats in the housing or continues to be located at the bottom within the housing, which may eventually form the initial solution to flow out of the housing after the toilet cleaner is dissolved or diluted.

Further, during a time between a time point when the volume of the initial solution in the housing reaches the maximum and a time point when the release of the initial solution ends, the concentration or solute content of the initial solution gradually increases.

Further, during a time between the time point when the volume of the initial solution in the housing reaches the maximum and a time point when the release of the primary solution ends, the concentration or solute content of the initial solution gradually increases.

The toilet cleaner in the housing is in a dry state before water enters the housing for the first time, and the concentration of the solution in the housing is zero at an instant when water enters the housing; the solid or granular toilet cleaner in the housing is in a wet state before water enters the housing for the second time or more, some initial solution from the last time remains in the housing, and at this time, the concentration of the solution in the housing has a certain initial value. When water gradually enters the housing, the water gradually dissolves and dilutes the toilet cleaner to form the initial solution, and then the initial solution is released from the housing. During a time between an instant when water enters the housing and an instant time point tx when the initial solution starts to be released, an overall trend of the concentration of the initial solution gradually increases.

When the water in the flush toilet just enters the housing, due to the fact that the toilet cleaner is solid with a certain weight and placed at the bottom of the housing, when the buoyancy generated by the amount of water entering the housing is smaller than the self-weight of the toilet cleaner, the toilet cleaner blocks the outlet of the housing and gradually dissolves during this period, so that the liquid concentration of the initial solution in the housing gradually increases; when the buoyancy generated by the amount of water entering the housing is larger than the self-weight of the toilet cleaner, the toilet cleaner starts to leave the outlet of the housing while the water enters the housing continuously, so that the liquid concentration of the initial solution in the housing gradually decreases during this period; finally, when no more water enters the housing, due to the fact that the amount of water flowing out of the housing in the initial solution is much smaller than an injected amount of water in the housing, the toilet cleaner continues to be dissolved in the water in the housing at this time while the concentration of the initial solution flowing out of the housing starts to increase again. Therefore, the concentration variation of the initial solution in the housing is from increase to decrease and is back to increase again. In an actual experimental process, the toilet cleaner is placed in the housing, an appropriate amount of liquid flowing out of the housing is collected at regular intervals, and the effective content of the toilet cleaner in the liquid can be measured.

Further, effective bleaching components released by the toilet cleaner itself or the toilet cleaner after being dissolved in water contains a chemical substance having the structural formula (1):

(1)

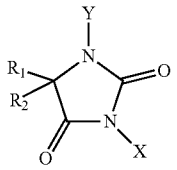

in which $R_1$ and $R_2$ are each independently selected from any one of $C_1$-$C_6$ alkyl substituents and hydrogen, and at least one of $R_1$ and $R_2$ should be a $C_1$-$C_6$ alkyl; X and Y are each independently selected from any one of bromine, chlorine and hydrogen, and at least one of X and Y should be a halogen element.

Further, the chemical substance of the effective bleaching component released by the toilet cleaner itself or the toilet cleaner after being dissolved in water is selected from any one of 1,3 dichloro-5,5-dimethylhydantoin,
1,3 dibrom-5,5-dimethylhydantoin,
1-bromo-3-chloro-5,5-dimethylhydantoin,
1-chloro-3-bromo-5,5-dimethylhydantoin,
1,3-dichloro-5-methyl-5-ethylhydantoin,
1,3-dibromo-5-methyl-5-ethylhydantoin,
1-bromo-3-chloro-5-methyl-5-ethylhydantoin,
1-chloro-3-bromo-5-methyl-5-ethylhydantoin,
1,3-dibromo-5-methyl-5-isobutylhydantoin, and
1,3-dibromo-5-methyl-5-propylhydantoin,
or a mixture of two or more of them.

Further, effective bleaching components released by the toilet cleaner itself or the toilet cleaner after being dissolved in water contains a chemical substance having the structural formula (2):

(2)

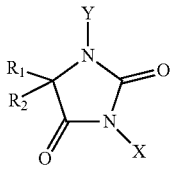

in which $R_1$ and $R_2$ are each independently selected from $C_1$-$C_2$ alkyl substituents, X and Y are each independently selected from any one of bromine, chlorine and hydrogen, and at least one of X and Y should be a halogen element.

Further, the chemical substance of the effective bleaching component released by the toilet cleaner itself or the toilet cleaner after being dissolved in water is selected from: any one or two of 1,3 dichloro-5,5-dimethylhydantoin,
1,3 dibrom-5,5-dimethylhydantoin,
1-bromo-3-chloro-5,5-dimethylhydantoin,
1-chloro-3-bromo-5,5-dimethylhydantoin,
1,3-dichloro-5-methyl-5-ethylhydantoin,
1,3-dibromo-5-methyl-5-ethylhydantoin,
1-bromo-3-chloro-5-methyl-5-ethylhydantoin, and
1-chloro-3-bromo-5-methyl-5-ethylhydantoin,
or a mixture of two or more of them.

In another aspect of the present invention, an extended-time release device for a toilet cleaner is provided, which is suitable for use in a toilet bowl. The device includes a bowl hook hung on an upper rim of the toilet bowl, a housing hook connected with the bowl hook, and a housing hung at the bottom of the housing hook;

the housing is used to place the toilet cleaner, the upper portion of the housing is provided with a water inlet, and the lower portion of the housing is provided with a gap for water to flow out; and the flexibility of the housing hook is greater than that of the bowl hook.

The technical solution of the present invention is suitable for solid toilet cleaners, such as solid blocks containing effective toilet cleaning substances, or water-permeable bags filled with solid particles of effective toilet cleaning substances, which are placed in the housing, then the housing fits and is placed on an inner side of the toilet bowl, and is hung and fixed by a hook. When the user presses the toilet to flush, the water in the toilet tank enters the water inlet of the housing from within the inner rim of the toilet bowl. Since the toilet flushing time is generally 5 to 120 seconds, the water inlet is preferably provided with a large-opening structure to ensure that adequate water enters the housing. When entering the housing, the water dissolves the solid and effective substances in the housing for toilet cleansing so as to form an effective solution, which slowly drips into the bowl from the gap left after the a left housing and a right housing are engaged. In this process, due to the fact that the effective solution has certain tension and that the tension correlates with liquid pressure, when the liquid level gradually drops, the dripping speed of the solution also gradually decreases while the concentration of the solution continues to rise, which is the advantage of delayed release. Furthermore, most of the solution is allowed to stay in the toilet, which ensures the content of effective substances of the toilet cleaner in the bowl, reduces the waste, and improves the using effect.

In addition, the flexibility of the housing hook and the bowl hook is controlled, so that the flexibility of the housing hook is greater than that of the bowl hook. The purpose of this arrangement is that: toilets of different brands or toilets of different models from the same brand are different in width and height of upper rim of the toilet bowl, radian of the inner wall of the bowl, and transition section between the bowl upper rim and the inner wall of the bowl. During the matching process, the housing and the bowl hook may be located in different relative positions, so that the housing hook can be stretched or compressed, and the bowl hook can be pulled in this process. Due to the fact that the flexibility of the housing hook is greater than that of the bowl hook, the deformation of the housing hook cannot affect the hanging stability of the bowl hook. Meanwhile, the upper portion of the housing is provided with a large-opening structure, the housing containing the toilet cleaner is hung at the bottom of the housing hook, and the bowl hook is hung on the upper rim of the toilet bowl, so that the housing and the housing hook are located in the bowl region. When the user flushes the toilet, water enters the housing from the large opening on the upper portion of the housing, and the liquid in the housing nearly overflows. In this process, the total weight of the housing hung on the housing hook gradually increases, but the strength of the housing hook can control the displacement of the housing to be in a certain range. Therefore, the relatively different designs of flexibility and strength of the housing hook and the bowl hook ensure the stability of the mounting position of the housing and the using effect. In addition, the technical solution of the present invention is realized through self-design of hook components, does not need an additional structure, and thus the technical solution is more universal, reduces the number of parts, reduces the probability of failure, and increases the life of the hook components.

Further, the housing includes a left housing and a right housing that are engaged with each other; protrusion portions are provided at engagement positions of the left housing and/or the right housing, and the protrusion portions leave a gap for water to flow out after the left housing and the right housing are engaged.

Since the housing is formed by engaging the left housing and the right housing, the size of the gap after the engagement can be controlled so as to control the time from the formation of the effective solution to the completion of dripping, which means the release period is extended. Specifically, by means of providing the protrusion portions at the engagement positions of the left housing and/or the right housing, axial spacing and radial spacing of the housing are controlled by controlling the height of the convex portions, and the protrusion portions can be integrally formed with the left housing or the right housing, which is easy to manufacture and can simply and effectively control the size of the gap for water to flow out. Under the interaction of liquid tension and liquid pressure, when the liquid level in the housing gradually drops, dripping speed of the effective solution also gradually decreases while the concentration of solution continues to increase, so that the effective solution with a higher concentration is released later. That is, the high-concentration effective solution is released into the bowl after the water surface in the bowl calms, and thus most of the effective ingredients of the toilet cleaner stay in the toilet, the content of effective ingredients of the toilet cleaner in the bowl is ensured, the waste is reduced, and the using effect is improved.

Further, in order to prevent the toilet cleaner placed in the housing from falling from the large opening of the housing under the action of water buoyancy after water enters the housing, a limit portion for restricting the movement of the toilet cleaner is provided in the housing.

Further, in order to improve the applicability of the device in the present invention and make the angle of the housing more flexible, the housing hook and the housing are arranged in a rotary connection or a flexible connection. The flexible connection is a connection that can connect the housing hook and the housing, in which the housing can change a hanging angle within a certain range.

Further, the bowl hook includes a vertical plate, a horizontal plate, a corner adapter plate and an inclined plate that are sequentially connected, in which the vertical plate and the horizontal plate tend to be arranged at right angles since the top surface and inner sides of the bowl upper rim have right-angle transitions.

The rigidity of the corner adapter plate is not greater than that of the vertical plate or the horizontal plate, and the flexibility of the vertical plate is arranged to be smaller than that of the inclined plate. In this way, regardless of the model size of the toilet bowl, appropriate deformation is made to the corner adapter plate to clamp the rim of the bowl, and the relative positions of the vertical plate and the rim of the bowl do not change, thereby providing a stable hanging foundation for the housing hook.

Further, the whole housing hook has an inverted hook-shaped structure, and a bending direction of a connecting end that connects the housing hook with the housing faces rim holes of the toilet bowl.

That is, the bending direction of the connecting end that connects the housing hook with the housing faces the rim holes of the toilet bowl, in which the bending direction is away from the vertical plate to allow the housing to fit the toilet bowl in a corresponding large size. When the toilet bowl has a corresponding small size, the housing hook deforms toward the inner wall of the toilet bowl so as fit more toilets with different models. In addition, the bending direction of the connecting end that connects the housing hook with the housing faces the rim holes of the toilet bowl, so that whether it is matched with a large-size bowl or a small-size bowl, the hung housing is closer to the rim holes, which is convenient for water to enter the housing from the water inlet.

Further, the housing hook and the bowl hook are in a fixed connection with an integrated hook structure. The housing hook is bent toward the toilet bowl, that is, the bending direction of the connecting end that connects the housing hook with the housing faces the rim holes of the toilet bowl, in which the bending direction is away from the vertical plate to allow the housing to fit the toilet bowl in a corresponding large size; when the toilet bowl has a corresponding small size, the housing hook generates appropriate deformation so as to fit more toilets with different models.

Further, the housing hook and the bowl hook are in a sliding connection, and the housing hook can slide up and down along the vertical plate. Preferably, the housing hook and the bowl hook are provided with a single quantitative sliding and a repeatable sliding structure. On the one hand, the arrangement of the sliding structure generates a detachable structure between the housing hook and the bowl hook, which can reduce package volume during package and transportation; on the other hand, the user can learn the adjustment method of the hook components in the present invention through an installation process during installing, which is convenient for the user to adjust according to actual situation of their own toilet, thereby improving the matching degree between the hook components and different models of toilets and obtaining a better using effect. In addition, the housing hook is bent toward the inside of the toilet bowl, that is, the housing hook is bent toward the rim holes of the toilet bowl, in which the bending direction is away from the vertical plate to allow the housing to fit the toilet bowl in a corresponding large size. When the toilet bowl has a corresponding small size, the housing hook deforms toward the inner wall of the toilet bowl so as to fit more toilets with different models.

Further, the sliding resistance of the sliding structure is greater than the total weight of the housing when being full of water, so that the position of the housing is stable during the whole service cycle.

Further, in a non-use state, a length of the bowl hook is L1=40 to 80 mm in order to be adapted to the width of the upper rim of the toilet bowl with different models; a distance between the bowl hook and the lowest point of the housing hook is L2=30 to 80 mm in order to be adapted to a height between the upper surface of the upper rim of the toilet bowl with different models and the water outlet positions of the toilet bowl, so that the housing can be partially attached to the inner wall of the toilet bowl. When the housing hook and the bowl hook are in a sliding connection, L2=30 to 80 mm; when the shell hook and the toilet bowl hook have an integrated hook structure, L2=45 to 80 mm. To ensure that a diversion plate can always fit the inner wall of the toilet bowl when the housing can be rotated within a certain range after the device of the present invention is installed on the toilet bowl, a distance between the bowl hook and the housing is L3=40 to 60 mm. To ensure that the bowl hook has sufficient clamping force, a vertical distance d between the inclined plate and the vertical plate is less than 35 mm.

Compared with the prior art, the present invention has the following beneficial effects.

According to the extended-time release method provided by the present invention, the replacement solution is formed by replacing the initial solution formed by the toilet cleaner and the water then the release rate of the replacement solution is controlled, so that the replacement solution reaches the dynamic balance, the solution is prevented from being washed away by the water flow in the flushing process, the content of the effective substances of the toilet cleaner in the bowl is ensured, most of the solution remains in the toilet, the effectiveness of the toilet cleaner is improved, the service life of the toilet cleaner with the same weight is prolonged, and the waste is reduced.

The extended-time release device provided by the present invention controls the time from the formation of the effective solution to the completion of dripping by controlling the size of the gap after the engagement of the left housing and the right housing, which means the release period is extended, so that most of the solution remains in the toilet, the content of effective substances of the toilet cleaner in the bowl is ensured, the waste is reduced, and the using effect is improved. In addition, as to the bowl hook in the present invention, regardless of the model size of the toilet bowl, appropriate deformation is made to the corner adapter plate to clamp the bowl upper rim, and the relative positions of the vertical plate and the bowl upper rim do not change, thereby providing a stable hanging foundation for the housing hook.

BRIEF DESCRIPTION OF THE DRAWINGS

FIG. 20 is a testing result of available chlorine contents in bowl water after a toilet cleaner containing different available chlorine components is selected according to the present invention.

FIG. 21 shows solubility of toilet cleaners used in the present invention.

FIG. 22 is a water-flow schematic view when a bowl is flushed with vertical water flows in the seventh embodiment.

DETAILED DESCRIPTION

Figure 1:
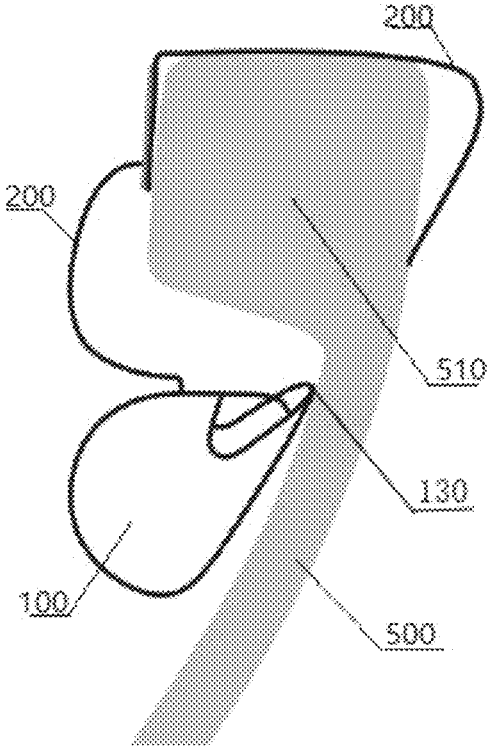
FIG. 1 is a schematic view of a device in use according to the present invention.

The drawings of the present invention are for illustrative purpose only and are not to be construed as limiting the invention. Some components in the drawings may be omitted, enlarged, or reduced for better illustrating the following embodiments, and sizes of these components do not represent that of actual products. For those skilled in the art, it will be understood that some known structures and descriptions thereof in the drawings may be omitted.

Embodiment 1

As shown in FIG. 1, an extended-time release device for a toilet cleaner is provided, which is suitable for use in a toilet bowl 500. The device includes a bowl hook 300 hung on a bowl upper rim 510 of the bowl, a housing hook 200 connected with the bowl hook 300, and a housing 100 hung at the bottom of the housing hook 200.

The housing 100 is used to place the toilet cleaner, an upper portion of the housing 100 is provided with a water inlet 130, and a lower portion of the housing 100 is provided with a gap for water to flow out. When in use, the water inlet 130 of the housing 100 is attached to an inner wall of the toilet bowl 500, which is convenient for the water to enter the housing 100 from the water inlet 130.

In addition, since different toilet bowls have different sizes, the flexibility of the housing hook 200 is arranged greater than that of the bowl hook 300 in order to improve the applicability of the device in the present embodiment, so that appropriate deformation can be made for the housing hook to match different toilet bowls and bear the weights of the housing 100 itself and the solution, and the water inlet 130 is ensured to be naturally attached to the inner wall of the toilet bowl 500.

Figure 2:
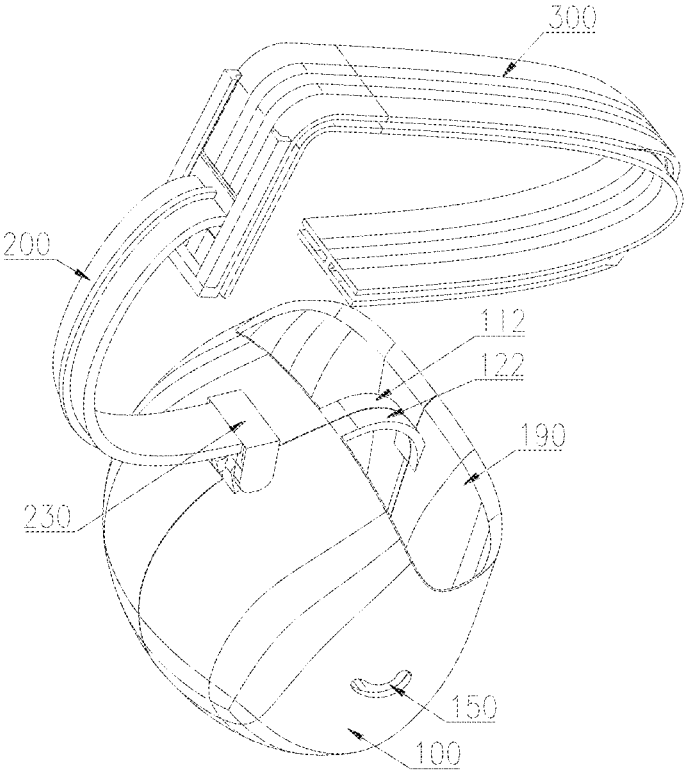
FIG. 2 is a structural view of an engaged housing according to a first embodiment according to the present invention.
Figure 10:
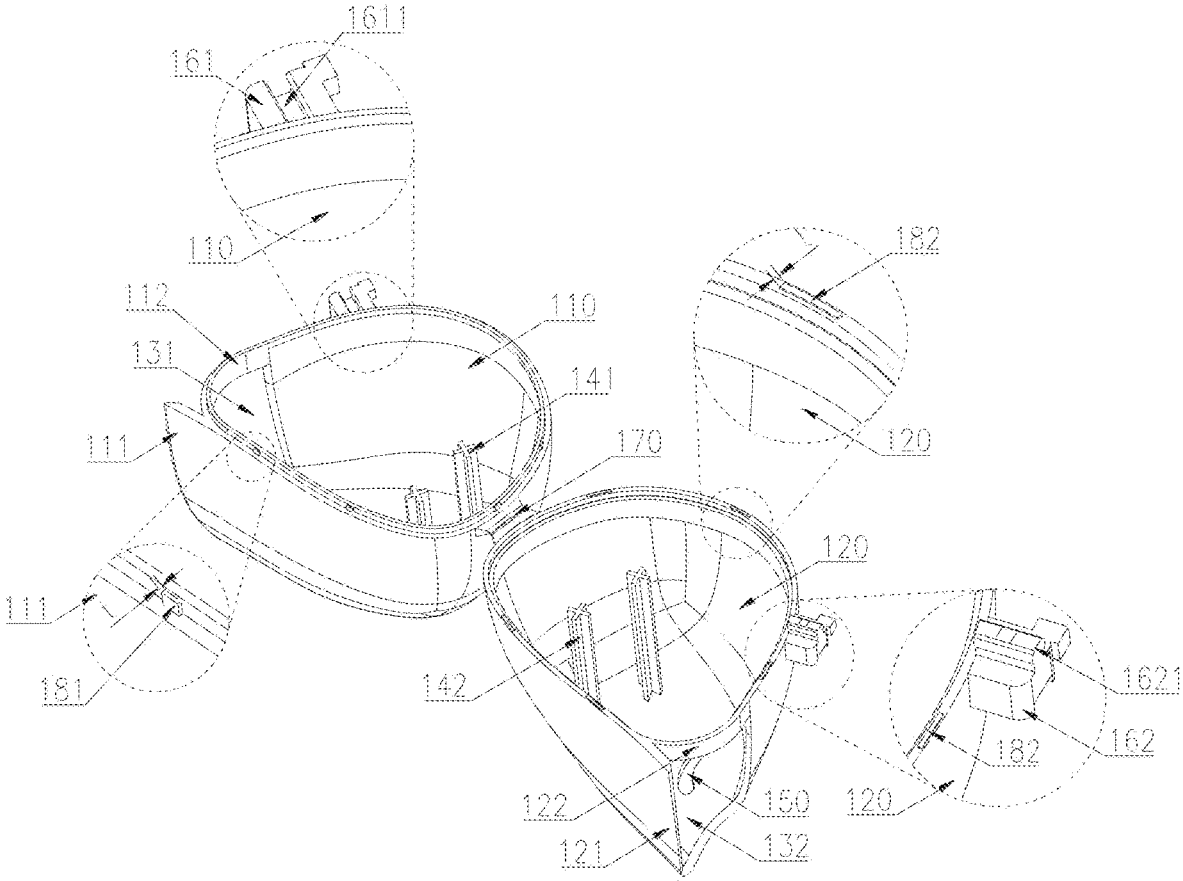
FIG. 10 is a structural view when the housing is opened according to the present invention.
Figure 11:
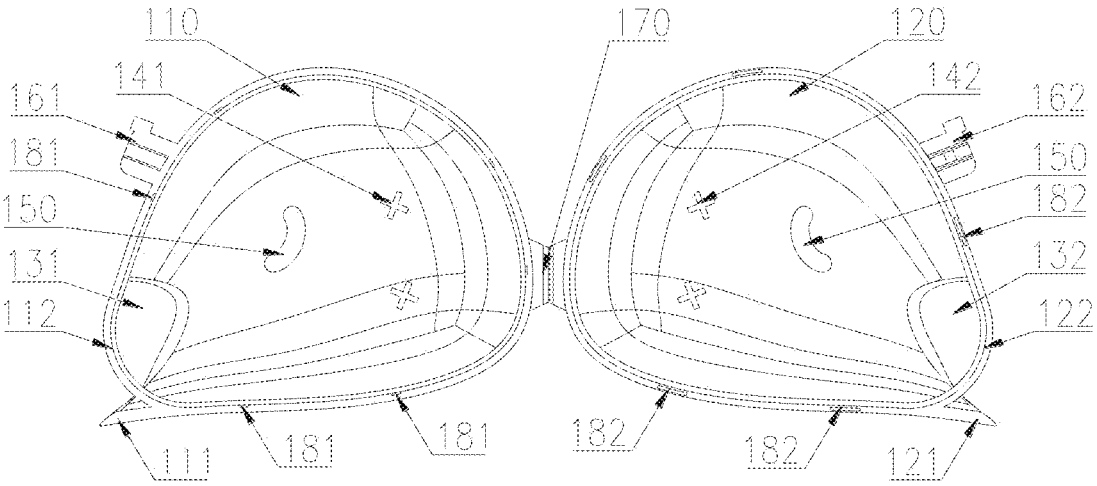
FIG. 11 is a top view of FIG. 9.
Figure 12:
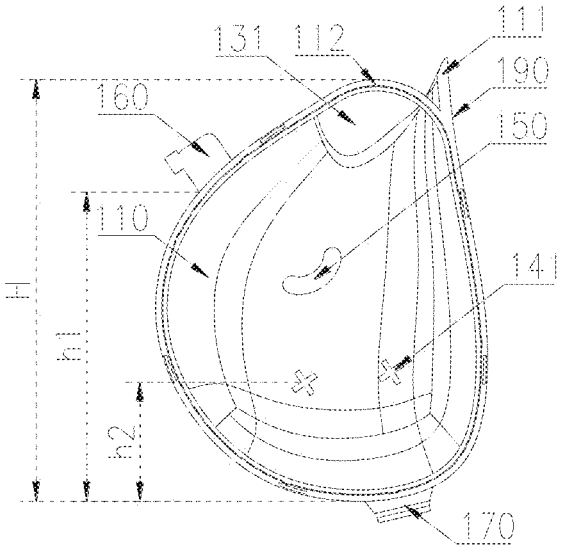
FIG. 12 is a side view when the housing is closed.

As can be seen from FIGS. 2, 10 and 11, the housing 100 is a bubble-shaped or a cylinder-shaped housing which is large in the middle and small at both ends. Preferably, the housing 100 includes a left housing 110 and a right housing 120 that are engaged with each other; protrusion portions are provided at engagement positions of the left housing 110 and/or the right housing 120, and the protrusion portions leave a gap for water to flow out after the left housing 110 and the right housing 120 are engaged. As shown in FIG. 12, a bulge position of the bubble-shaped housing is arranged to be located between ⅓ and ½ of a height of the housing 100 from bottom to top, that is, $h1-h2/H=⅓$ to ½, so that after the housing 100 contains the toilet cleaner and water enters the housing, a gravity center is located at the lower portion of the housing 100. When the housing 100 is hung in the toilet bowl 500, the hanging is more stable and not easy to swing, which is convenient for the water to enter the housing 100 from the water inlet 130.

Specifically, an outer edge of the left housing 110 is arranged as a protruding ring, an outer edge of the right housing 120 is arranged as a recessed ring, and the protruding ring and the recessed ring are engaged with each other. In this embodiment, a radial direction is defined as a radial direction of a circumference of the protruding ring or the recessed ring, and an axial direction is defined as a height direction of the protruding ring or the recessed ring. The protrusion portion includes: several protruding blocks 181 or protruding points provided on the protruding ring, or several protruding bars 182 or protruding points provided on the recessed ring. The protruding blocks 181, the protruding bars 182, and/or the protruding points are used to ensure that a stable gap exists between the left housing 110 and the right housing 120 in the radial and axial directions, so that a gap is formed between the left housing 110 and the right housing 120. Preferably, all the protrusion portions can be integrally formed when the left housing and the right housing are molded, and the size of the gap can be controlled by presetting the height of the protrusion portions, so that the extended-time release time of the effective solution can be indirectly and accurately controlled. The height of the protrusion portion is set to t=0.1 to 0.5 mm, and it is preferably that t=0.1 or 0.2 or 0.3 or 0.4 or 0.5 mm.

The water inlet 130 includes a left opening 131 provided on the top of the left housing 110 and a right opening 132 provided on the top of the right housing 120. The left opening 131 and the right opening 132 jointly form the water inlet 130. Preferably, the protruding ring or the recessed ring that are formed by the engagement of the left housing 110 and the right housing 120 is a closed ring, so that the gap after engagement is in a stable state. Further, the left opening 131 and the left housing 110 share a left opening connecting portion; the right opening 132 and the right housing 120 share a right opening connecting portion. The left opening 131 can be a U-shaped opening in a left-right direction, or a U-shaped hole; the left housing 110 is not completely separated at the left opening 131, and is provided with the left opening connecting portion 112. In a similar way, the right opening 132 can be a U-shaped opening in the left-right direction, or a U-shaped hole; the right housing 120 is not completely separated at the right opening 132, and is provided with the right opening connecting portion 122. When the left housing 110 and the right housing 120 are engaged, the two U-shaped openings or U-shaped holes jointly form a large-opening structure similar to an oval shape, which ensures that a sufficient amount of water enters the housing 100 in a short time. In addition, the engagement of the remained left opening connecting portion 112 and the right opening connecting portion 122 allows a part of the housing to form a closed ring so as to ensure controllability of a fitting gap.

Preferably, a diversion plate 190 is provided at a position where the water inlet 130 faces the inner wall of the toilet bowl 500. The diversion plate 190 includes a left extension plate 111 provided on a side of the left housing 110 facing the water inlet 130 and a right extension plate 121 provided on a side of the right housing 120 facing the water inlet 130. After the left housing 110 and the right housing 120 are engaged, the left extension plate 111 and the right extension plate 121 jointly form the diversion plate 190. Specifically, the left extension plate 111 and the right extension plate 121 allow side cross-sections of the left housing 110 and the right housing 120 to form an inverted q-shaped profile; the left extension plate 111 and the right extension plate 121 are formed by extending the left housing 110 and the right housing 120, and can be integrally formed when the left housing 110 and the right housing 120 are molded. Since water in the toilet bowl flows out from an upper inner wall of the bowl, the left extension plate 111 and the right extension plate 121 are provided in order to ensure that the water can enter the water inlet 130 smoothly; the left extension plate 111 and the right extension plate 121 are arranged as curved surfaces, so that the diversion plate 190 formed after the left housing 110 and the right housing 120 are engaged is a complete left-right smooth curved surface, and thus the diversion plate can fit the inner wall of the toilet bowl 500, reduce the gap between the housing 100 and the inner wall of the toilet bowl 500, and ensure that as much water as possible enters the water inlet 130 along the diversion plate 190.

Preferably, a connecting piece 170 used to connect the left housing 110 and the right housing 120 is provided at the bottom of the housing 100, and a connection structure 160 is provided at the upper portion of the housing 100. The connecting piece 170 is fixedly provided at the bottom of the housing 100, which facilitates one-to-one engagement of the left housing 110 and the right housing 120, avoids a situation where multimode-cavity products are matched with each other, generates a more stable fitting gap, and reduces the difficulty of production control. The connection structure 160 is provided on the upper portion of the housing, that is, on the other side opposite to the connecting piece. The connection structure includes a buckle portion 161 provided at an edge of the protruding ring of the left housing, and a fitting portion 162 provided at the recessed ring of the right housing; the buckle portion 161 is provided with an engaging groove 1611; the fitting portion 162 is provided with a raised engaging block 1621. After the left housing 110 and the right housing 120 are engaged, the engaging block 1621 is embedded into the engaging groove 1611, and is matched with the connecting piece 170 to fasten the left housing 110 and the right housing 120 to form the housing 100. Furthermore, a rotating groove (not shown) is provided on the outside of the buckle portion 161 and the fitting portion 162.

Preferably, a limit portion 140 for restricting the movement of the toilet cleaner is provided in the housing 100. At least one group of limit portions 140 is provided, and the cross section of the limit portion 140 is rectangular, circular or cross-shaped. The limit portion 140 is composed of a left limiting rod 141 and a right limiting rod 142. One end of the left limiting rod 141 is fixed to the inside of the left housing 110, and one end of the right limiting rod 142 is fixed to the inside of the right housing 120. Preferably, the left limiting rod 141 and the right limiting rod 142 can be arranged in a docked or staggered manner. The left limiting rod 141 and the right limiting rod 142 have the same length. When the two are arranged in a docked manner, a gap therebetween is not larger than a minor diameter of the toilet cleaner or a width of a toilet-cleaner packaging bag for containing the toilet cleaner, and the length does not hinder the left housing 110 from engaging with the right housing 120.

Preferably, since toilets with different models vary in flushing volume, small holes 150 are provided on the sides of the left housing 110 and right housing 120 in order to control the total amount of water entering the housing 100, so that the highest water level in the housing 100 can be controlled. Combined with the shape of the housing 100, it can be ensured that when the small holes are used on toilets with different models, the total amount of water entering the housing 100 is constant, which reduces deviation, ensures a consistent concentration of the effective solution formed after the toilet cleaner is dissolved, ensures a consistent using effect of the effective solution after dripping into the bowl, and ensures that the service life of the toilet cleaner is consistent between toilets with different models.

Preferably, a small hole 150 is set as a downwardly concave arc-shaped hole, and a setting location of the small hole 150 needs to ensure that the water volume entering the housing 100 is 10 to 50 ml. Preferably, the arc-shaped hole is obliquely arranged, and one side facing the diversion plate 190 is the higher end. The purpose of this arrangement is that, when the present invention is used in toilets with different models, the upper rim of the diversion plate 190 fits the inner wall of the toilet bowl, then the housing 100 deflects towards one side away from the diversion plate 190 along the upper rim of the diversion plate 190. At this time, a position at the lowest point of the inclined arc-shaped hole deflects a little so as to ensure that an initial water storage volume in the housing 100 tends to be consistent.

Figure 15:
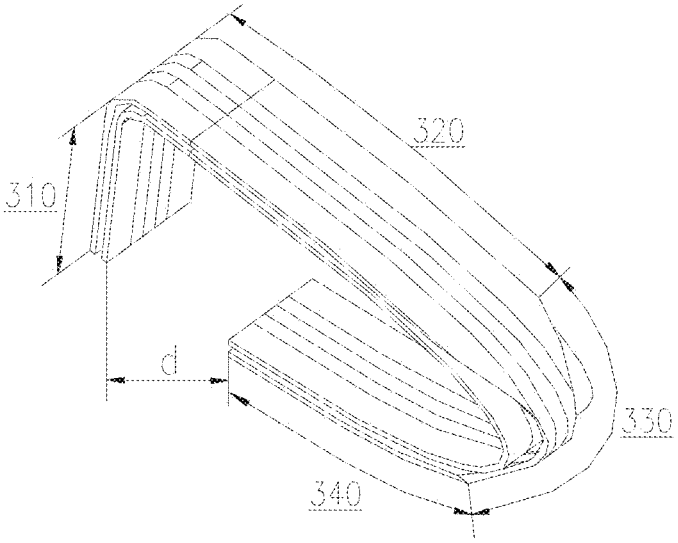
FIG. 15 is a structural view of the bowl hook according to the present invention.

As shown in FIG. 15, the bowl hook 300 includes a vertical plate 310, a horizontal plate 320, a corner adapter plate 330 and an inclined plate 340 that are sequentially connected. The vertical plate 310 and the horizontal plate 320 tend to be arranged at right angles; the rigidity of the corner adapter plate 330 is not greater than that of the vertical plate 310 or the horizontal plate 320. In this way, regardless of the model size of the toilet bowl, appropriate deformation is made to the corner adapter plate 330 to clamp the rim of the bowl, and the relative positions of the vertical plate 310 and the rim of the bowl do not change, thereby providing a stable hanging foundation for the housing hook 200.

The manner in which the rigidity of the corner adapter plate 330 is minimized is setting a cross-sectional area of the corner adapter plate 330 to be smaller than the vertical plate 310 or the horizontal plate 320 or the inclined plate 340. Preferably, the cross-sectional area of the corner adapter plate 330 is set with a distribution tendency to be large at both ends and small in the middle. During manufacturing, the flexibility of the corner adapter plate 330 can be quantitatively controlled in a simple and effective manner. To ensure that the horizontal plate 320 fits the upper surface of the bowl upper rim 510 of the toilet as much as possible when the bowl hook 300 deforms to a certain extent, and to ensure a fitting area of the inclined plate 340 and the outer wall of the toilet bowl 500, the flexibility of the vertical plate 310 is preferably arranged to be smaller than that of the inclined plate 340. In use, regardless of the model size of the toilet bowl, appropriate deformation is made to the corner adapter plate 330 and the inclined plate 340 to allow the bowl hook to clamp the rim of the bowl, and the relative positions of the vertical plate 310 and the rim of the bowl do not change, thereby providing a stable hanging foundation for the housing hook 200.

Preferably, since an I-shaped or T-shaped structure can save materials to the utmost extent and ensure that the bowl hook fits the upper rim of the toilet with sufficient strength, the cross-section of the bowl hook 300 is arranged to be an I-shaped or T-shaped structure. When the cross section is an I-shaped structure, the overall change of flexibility of the bowl hook 300 can be adjusted by controlling the width of the I-shaped upper plate; when the cross section is a T-shaped structure, the overall change of flexibility of the bowl hook 300 can be adjusted by controlling the height of the T-shaped vertical plate; the two adjustment methods can ensure the area of that the bowl hook 300 fits the area of one side of the toilet bowl 500 or the bowl upper rim 510 of the toilet, so that the housing 100 containing the toilet cleaner is more stable when in use. In addition, the cross section of the bowl hook can also be arranged in a straight-line shape, that is, the bowl hook has a plate-shaped structure.

Referring to FIGS. 1, 2, 8, and 15, it can be seen that the whole housing hook 200 has an inverted hook-shaped structure, and a bending direction of a connecting end that connects the housing hook with the housing 100 faces rim holes 520 of the toilet bowl 500. That is, the bending direction of the housing hook 200 is away from the vertical plate 310 to allow the housing 100 to fit the toilet bowl 500 in a corresponding large size of rim section; when the toilet bowl 500 has a corresponding small size of rim section, the housing hook 200 generates appropriate deformation on the inner wall so as to fit more toilets with different models. In addition, the bending direction of the connecting end that connects the housing hook 200 with the housing 100 faces the rim holes 520 of the toilet bowl 500, so that whether it is matched with a large-size bowl or a small-size bowl, the hung housing 100 is closer to the rim holes 520, which is convenient for water to enter the housing from the water inlet.

Figure 8:
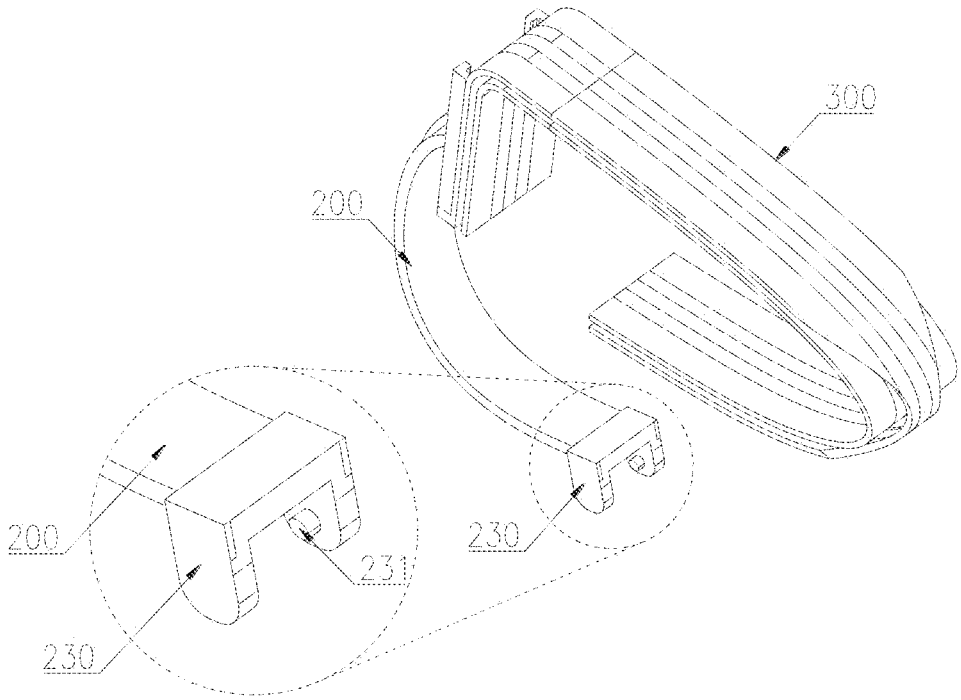
FIG. 8 is a structural view of a connection between a housing hook and a housing in the first embodiment, the second embodiment, and the fifth embodiment.

As shown in FIG. 8, the lower end of the housing hook 200 is provided with a rotating portion 230, the rotating portion 230 is inserted into a rotating groove provided outside the buckle portion 161 and the fitting portion 162 via a rotating shaft 231, so that the rotating portion 230 rotates relative to the connection structure 160. Specifically, the rotating portion 230 is a II-shaped structure fixedly attached to the lower end of the housing hook 200, a pair of rotating shafts 231 are provided on the inner side of both vertical plates of the II-shaped structure, so that the rotating shaft 231 can rotate within the groove. The structure is simple and easy to assemble, the housing 100 can be rotated within a range, and the housing hook 200 and the housing 100 are detachable structures, which reduces the packaging volume and facilitates storage and transportation.

Figure 13:
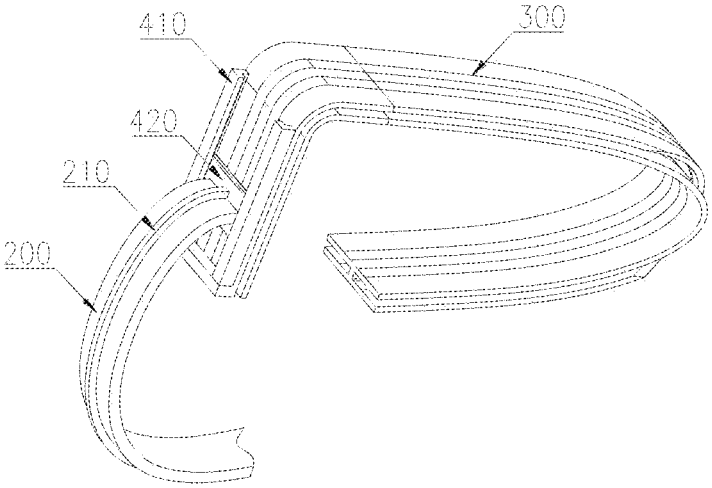
FIG. 13 is a structural view of a connection between of the housing hook and a bowl hook in the first embodiment and the third embodiment.

As shown in FIGS. 1 and 13, the cross section of the housing hook 200 is arranged in a straight-line shape or T-shaped. When the cross section is in a straight-line shape, that is, the housing hook 200 has a plate-shaped structure, and the overall change of flexibility of the housing hook 200 is adjusted by controlling the width of the plate-shaped structure. When the cross section is a T-shaped structure, the overall change of flexibility of the housing hook 200 is adjusted by adjusting the height of the T-shaped vertical plate. The cross section of the housing hook 200 is smaller than that of the bowl hook 300. When the same material is used for manufacturing, it can be ensured that the overall flexibility of the housing hook 200 is greater than that of the bowl hook 300.

As shown in FIG. 13, the housing hook 200 and the bowl hook 300 are in a sliding connection, and the housing hook 200 can slide up and down along the vertical plate 310. Specifically, an accommodating groove 410 is provided on the outer surface of the vertical plate 310, and is a U-shaped structure composed of two oppositely provided L-shaped structures with L-shaped sections on both sides and a sealing plate at the bottom. The upper portion of the housing hook 200 is provided with a sliding block 420 that matches the accommodating groove 410. The sliding block 420 can slide up and down in the U-shaped structure. Furthermore, the L-shaped structure is set in a tooth shape, and the sliding block 420 can be clamped in the adjacent two teeth to realize the purpose of single quantitative sliding and multiple sliding, which is also convenient for the user to intuitively learn an adjustment amount.

Further, the sliding resistance of the sliding structure is greater than the total weight of the housing 100 when being full of water, so that the position of the housing 100 is stable during the whole service cycle.

Figure 19:
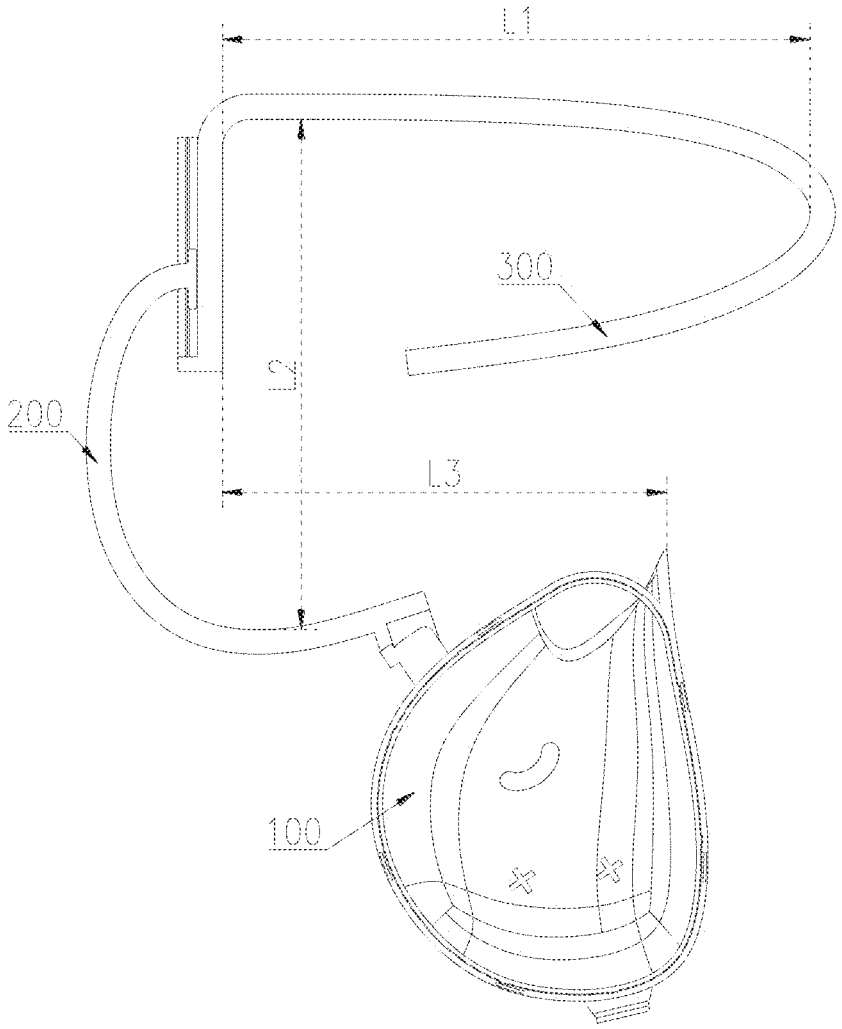
FIG. 19 is a view of dimensional relationship for the device according to the present invention.

As shown in FIG. 19, in order to be adapted to the width of the bowl upper rim 510 of the toilet with different models, the length of the bowl hook 300 is set to L1=40 to 80 mm, and preferably, L1=40 mm or 50 mm or 60 mm or 70 mm or 80 mm.

A distance between the bowl hook 300 and the lowest point of the housing hook 200 is L2=30 to 80 mm in order to be adapted to a height between the upper surface of the bowl upper rim 510 of the toilet with different models and the water outlet positions of the toilet bowl, so that the housing can be partially attached to the inner wall of the toilet bowl 500.

To ensure that the diversion plate 190 can always fits the inner wall of the toilet bowl 500 when the housing 100 can be rotated within a certain range after the device of the present invention is installed on the toilet bowl 500, a distance between the bowl hook 300 and the housing 100 is L3=40 to 60 mm.

To ensure that the bowl hook has sufficient clamping force, a vertical distance d between the inclined plate and the vertical plate is less than 35 mm. As shown in FIG. 15, a vertical distance between the inclined plate 340 and the vertical plate 310 in this embodiment is 20 mm.

Embodiment 2

Figure 3:
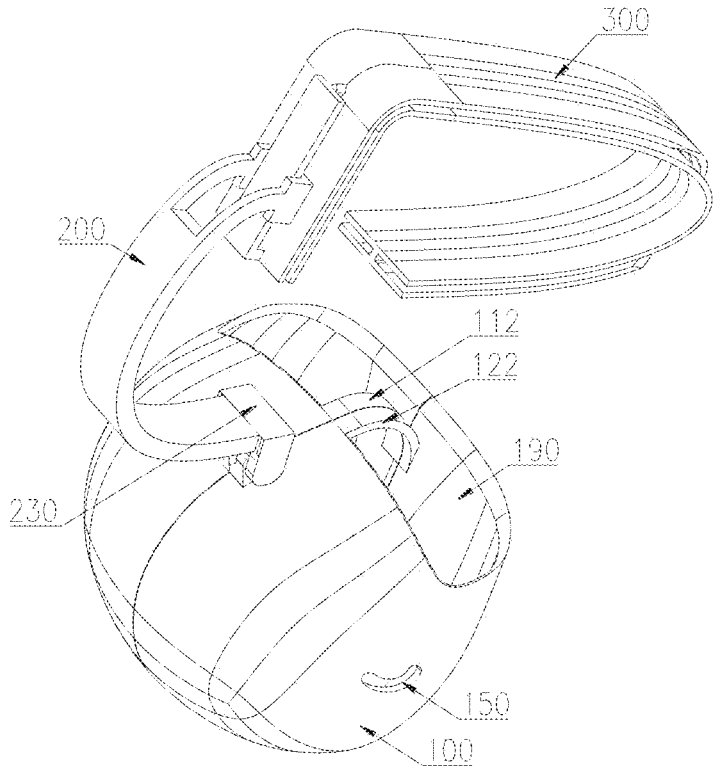
FIG. 3 is a structural view of the engaged housing according to a second embodiment according to the present invention.

As shown in FIG. 3, the second embodiment differs from the first embodiment only in that: the housing hook 200 has a plate-shaped structure, the housing hook 200 and the bowl hook 300 are in a sliding connection, and the housing hook 200 can slide up and down along the vertical plate 310.

Figure 14:
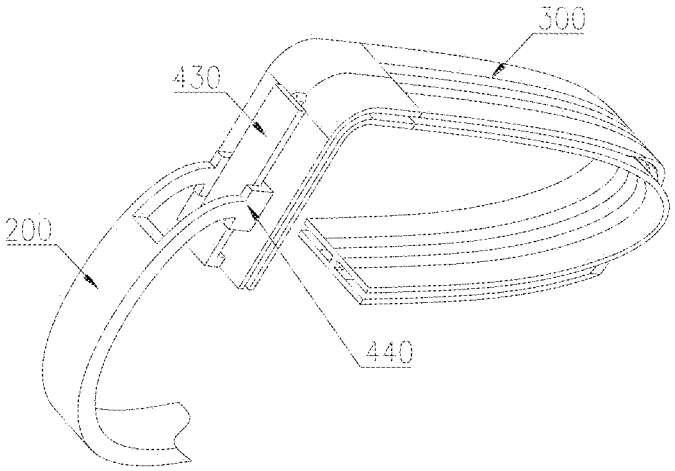
FIG. 14 is a structural view of the connection between of the housing hook and the bowl hook in the second embodiment and the fourth embodiment.

Specifically, as shown in FIG. 14, a sliding rod 430 is fixed on the outer surface of the vertical plate 310, and the sliding rod 430 is composed of a T-shaped structure and a sealing plate provided at the bottom of the T-shaped structure. The vertical plate of the T-shaped structure is vertically and fixedly connected with the vertical plate 310, and the horizontal plate of the T-shaped structure extends along the vertical plate 310. The upper portion of the housing hook 200 is provided with a sliding groove 440 that can slide up and down along the sliding rod 430. The sliding groove 440 is in interference fit with the sliding rod 430, and the sliding groove 440 is composed of two oppositely provided L-shapes, in which the two oppositely provided L-shapes are composed of two branches extending from the upper portion of the housing hook 200, and a certain gap exists between the two branches. Furthermore, the vertical plate of the T-shaped structure of the sliding rod 430 is set in a tooth shape, and the sliding groove 440 can be clamped in the adjacent two teeth to realize the purpose of single quantitative sliding and multiple sliding, which is also convenient for the user to intuitively learn an adjustment amount.

Embodiment 3

Figure 4:
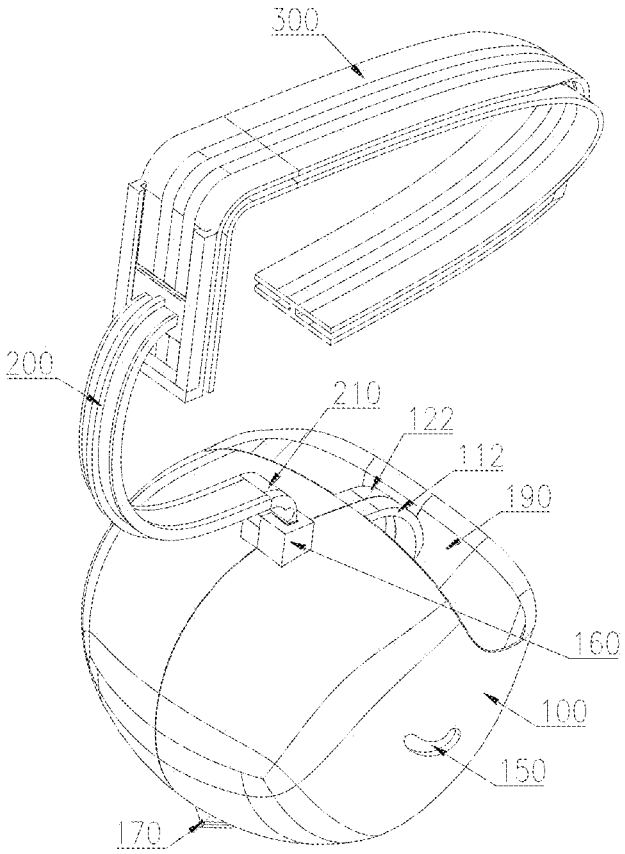
FIG. 4 is a structural view of the engaged housing according to a third embodiment according to the present invention.

As shown in FIG. 4, the third embodiment differs from the first embodiment only in that: In order to reduce assembly steps in use for the user, the housing hook 200 and the housing 100 are arranged in a flexible connection, which reduces the disassembly and assembly steps and is convenient for the user to use.

Figure 9:
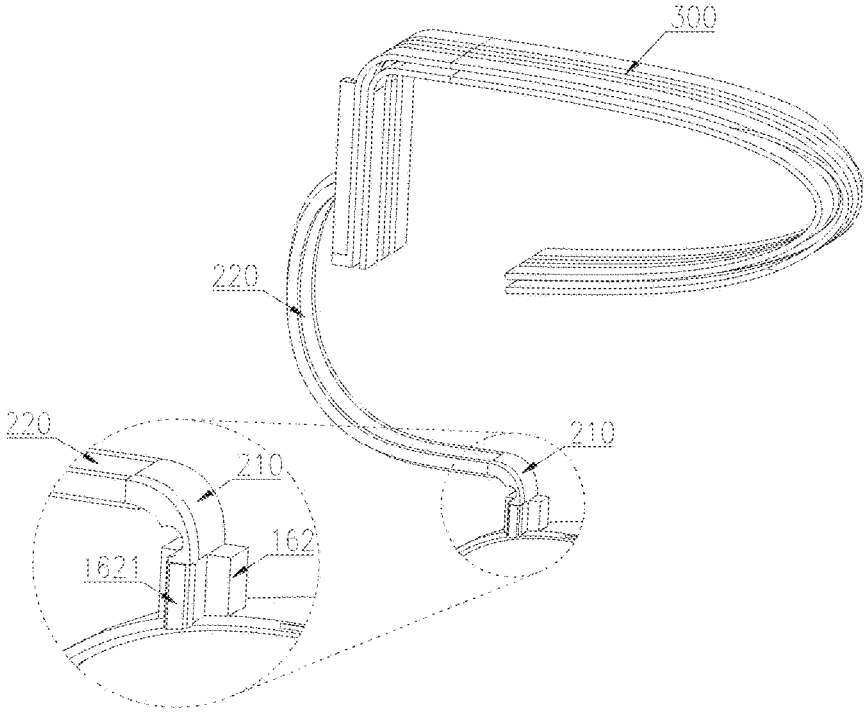
FIG. 9 is a structural view of the connection between the housing hook and the housing in the third embodiment, the fourth embodiment, and the sixth embodiment.

Specifically, as shown in FIG. 9, the housing hook 200 includes an end segment 210 fixedly connected to the fitting portion 162, and an arc segment 220 connected with the end segment 210; the flexibility of the arc segment 220 is smaller than that of the end segment 210; a bending direction of the arc segment 220 faces a side away from the vertical plate 310, that is, the arc segment 220 is bent toward the center of the toilet bowl 500, so that the housing 100 can fit the toilet bowl 500 in a corresponding large size. When the toilet bowl 500 has a corresponding small size, appropriate deformation is made to the housing hook 200 so as to fit more toilets with different models. When water enters the housing 100, the weight of the housing 100 and the toilet cleaner causes the gravity center of the housing to change. At this time, the flexibility of the end segment 210 may bend and deform to adapt to the change of the gravity center, so that the water inlet of the housing 100 is tightly attached to the inner wall of the bowl. The strength of the arc segment can bear the weight of the housing and the solution, which ensures that the position of the relative height of the housing 100 does not change greatly and is kept close to the rim hole 520 of the bowl. This design allows the water flowing out of the rim hole 520 of the toilet bowl to smoothly flow in large quantities into the housing along the inner wall of the toilet bowl 500.

As shown in an enlarged view in FIG. 9, the end segment 210 is also provided with a concave area near the fitting portion 162, which is to further increase the flexibility of the end segment 210, so that an adjustment range of the housing 100 under the action of gravity is larger after water enters the housing. The cross section of the arc segment 220 is an inverted T-shaped structure, and the cross section of the end segment 210 is a flat-plate structure. Preferably, the horizontal plate of the T-shaped structure of the arc segment 220 is integrally formed with the end segment 210, and the vertical plate of the T-shaped structure is provided in the arc segment 220, so that structural material of the housing hook 200 is more economical, simple and effective.

Embodiment 4

Figure 5:
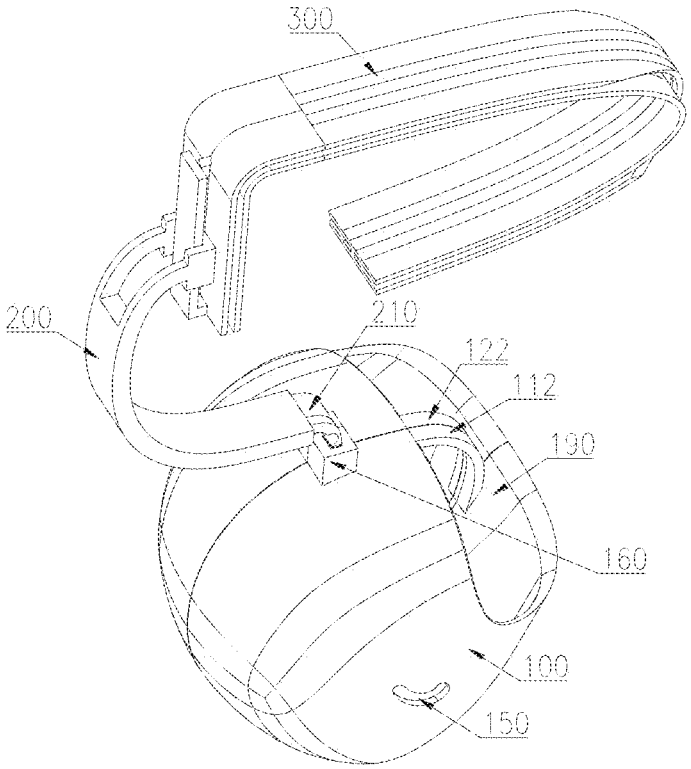
FIG. 5 is a structural view of the engaged housing according to a fourth embodiment according to the present invention.

As shown in FIG. 5, the fourth embodiment differs from the third embodiment only in that: The housing hook 200 has a plate-shaped structure, the housing hook 200 and the bowl hook 300 are in a sliding connection, and the housing hook 200 can slide up and down along the vertical plate 310. The fourth embodiment differs from the second embodiment in that: the housing hook 200 and the housing 100 are in a flexible and fixed connection to replace a rotating shaft structure by local flexible deformation of a connecting position.

Specifically, as shown in FIG. 14, the sliding rod 430 is fixed on the outer surface of the vertical plate 310, and the sliding rod 430 is composed of a T-shaped structure and a sealing plate provided at the bottom of the T-shaped structure. The vertical plate of the T-shaped structure is vertically and fixedly connected with the vertical plate 310, and the horizontal plate of the T-shaped structure is parallel to the vertical plate 310. The upper portion of the housing hook 200 is provided with a sliding groove 440 that can slide up and down along the sliding rod 430. The sliding groove 440 is in interference fit with the sliding rod 430, and the sliding groove 440 is composed of two oppositely provided L-shapes, in which the two oppositely provided L-shapes are composed of two branches extending from the upper portion of the housing hook 200, and a certain gap exists between the two branches. Furthermore, the vertical plate of the T-shaped structure of the sliding rod 430 is set in a tooth shape, and the sliding groove 440 can be clamped in the adjacent two teeth to realize the purpose of single quantitative sliding and multiple sliding, which is also convenient for the user to intuitively learn an adjustment amount.

Embodiment 5

Figure 6:
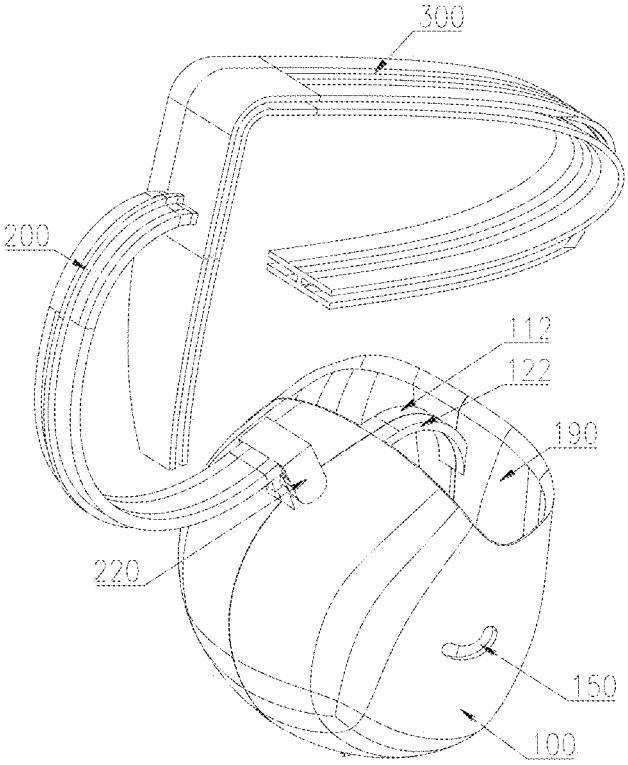
FIG. 6 is a structural view of the engaged housing according to a fifth embodiment according to the present invention.

As shown in FIG. 6, the fifth embodiment differs from the first embodiment only in that: The housing hook 200 and the bowl hook 300 are in a fixed connection with an integrated hook structure, and the rigidity of the housing hook 200 is smaller than that of the bowl hook 300. The housing hook 200 is bent toward the inside of the toilet bowl 500, that is, the bending direction of a connecting end that connects the housing hook 200 with the housing 100 faces the rim holes 520 of the toilet bowl and is away from the vertical plate 310 to allow the housing 100 to fit the toilet bowl 500 in a corresponding large size; when the toilet bowl 500 has a corresponding small size, the housing hook 200 generates deformation toward the inner wall of the toilet bowl 500 so as to fit more toilets with different models.

Figure 16:
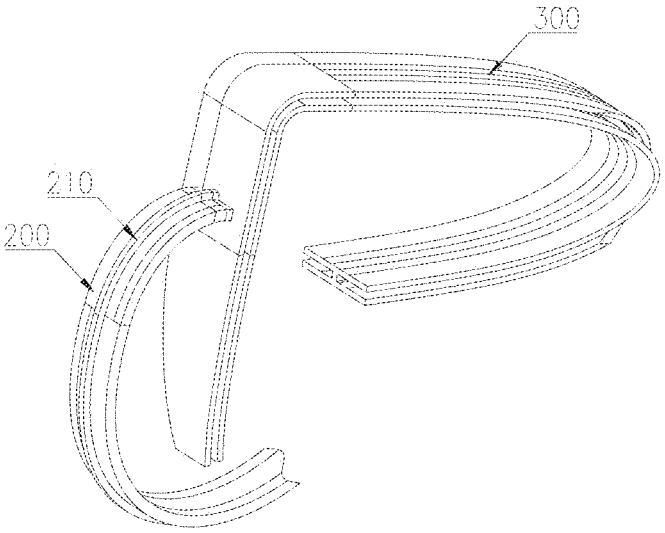
FIG. 16 is a perspective view of the housing hook and the bowl hook in the fifth embodiment and the sixth embodiment.
Figure 17:
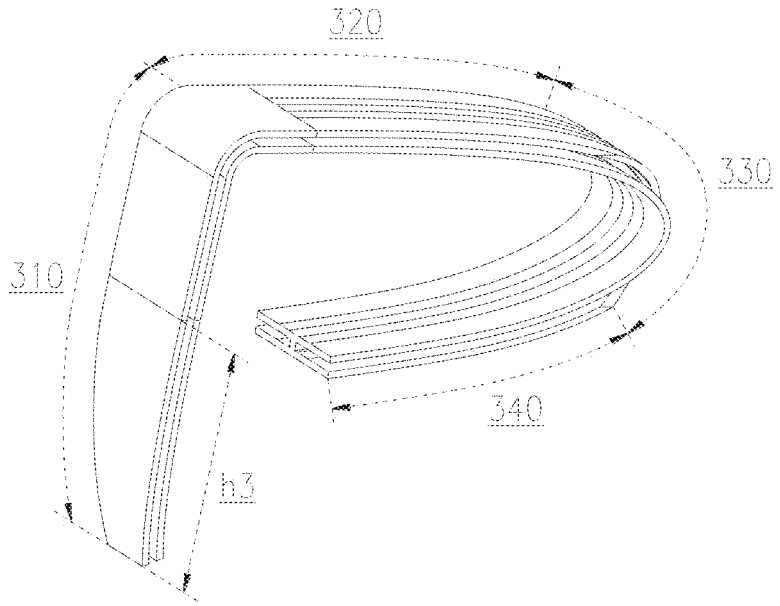
FIG. 17 is a perspective view of the housing hook in the fifth embodiment and the sixth embodiment.

Specifically, as shown in FIGS. 16 and 17, the bowl hook 300 includes the vertical plate 310, the horizontal plate 320, the corner adapter plate 330 and the inclined plate 340 that are sequentially connected. The vertical plate 310 and the horizontal plate 320 tend to be arranged at right angles; the rigidity of the corner adapter plate 330 is not greater than that of the vertical plate 310 or the horizontal plate 320 or the inclined plate 340. In this way, regardless of the model size of the toilet bowl, appropriate deformation is made to the corner adapter plate 330 to clamp the bowl upper rim 510, and the relative positions of the vertical plate 310 and the bowl upper rim 510 do not change, thereby providing a stable hanging foundation for the housing hook 200.

Figure 18:
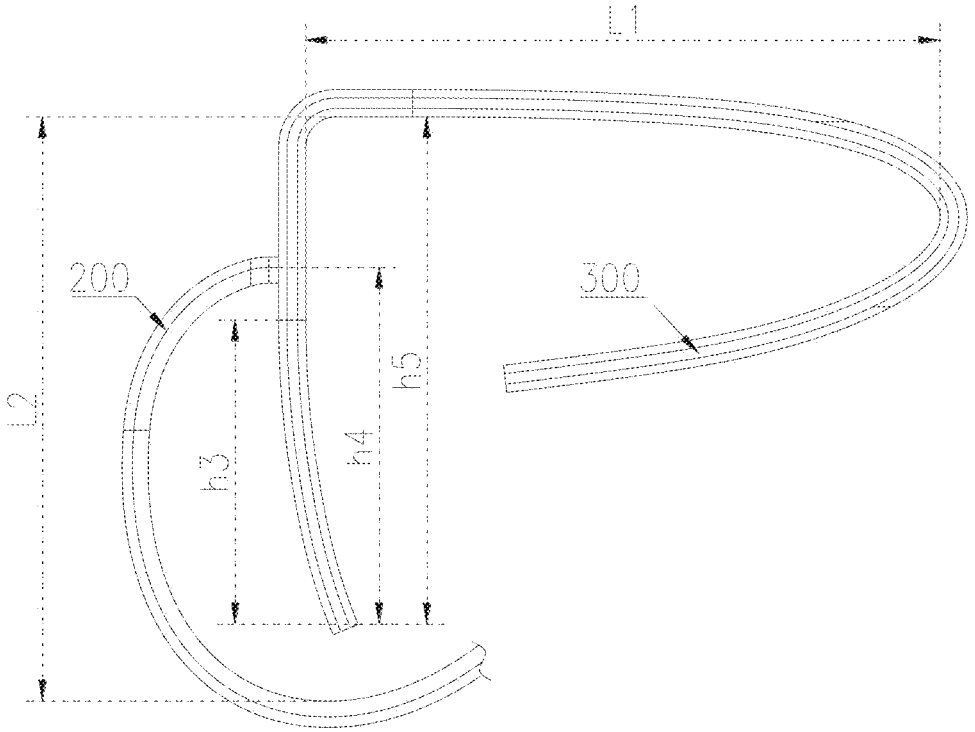
FIG. 18 is a side view of the housing hook and the bowl hook in the fifth embodiment and the sixth embodiment.

As shown in FIG. 18, in order to ensure that a vertical deformation amount of the housing hook 200 does not exceed 5 mm, the housing hook 200 and the housing 100 are arranged on the upper middle portion of the vertical plate 310. That is, a height h4 between a connection point connecting the bowl hook 300 and the housing hook 200 and a free end of the vertical plate 310, and a total height h5 of the vertical plate 310 satisfy: h4/h5=0.3 to 0.8; preferably, h4/h5=0.3 or 0.4 or 0.5 or 0.6 or 0.7 or 0.8.

Since the vertical plate 310 fits the inner wall of the bowl upper rim 510 of the toilet, it is only necessary to ensure that the vertical plate 310 adjacent to the upper surface of the bowl upper rim 510 of the toilet has sufficient support strength. To reduce the overall weight of the hook itself and the use of the material and increase the flexibility of the vertical plate 310, the cross-sectional area of the vertical plate 310 is set to gradually decrease at least in the lower middle section of the vertical plate 310. A height h3 of the section where the cross-sectional area of the vertical plate 310 gradually decreases and the total height h5 of the vertical plate 310 satisfy: h3/h5=0.5 to 0.7; preferably, h3/h5=0.5 or 0.6 or 0.7.

As shown in FIG. 19, in order to be adapted to the width of the bowl upper rim 510 of the toilet with different models, the length of the bowl hook 300 is set to L1=40 to 80 mm, and preferably, L1=40 mm or 50 mm or 60 mm or 70 mm or 80 mm.

A distance between the bowl hook 300 and the lowest point of the housing hook 200 is L2=45 to 80 mm in order to be adapted to a height between the upper surface of the bowl upper rim 510 of the toilet with different models and the water outlet positions of the toilet bowl, so that the housing can be partially attached to the inner wall of the toilet bowl 500.

To ensure that the diversion plate 190 can always fits the inner wall of the toilet bowl 500 when the housing 100 can be rotated within a certain range after the device of the present invention is installed on the toilet bowl 500, a distance between the bowl hook 300 and the housing 100 is L3=40 to 60 mm.

Embodiment 6

Figure 7:
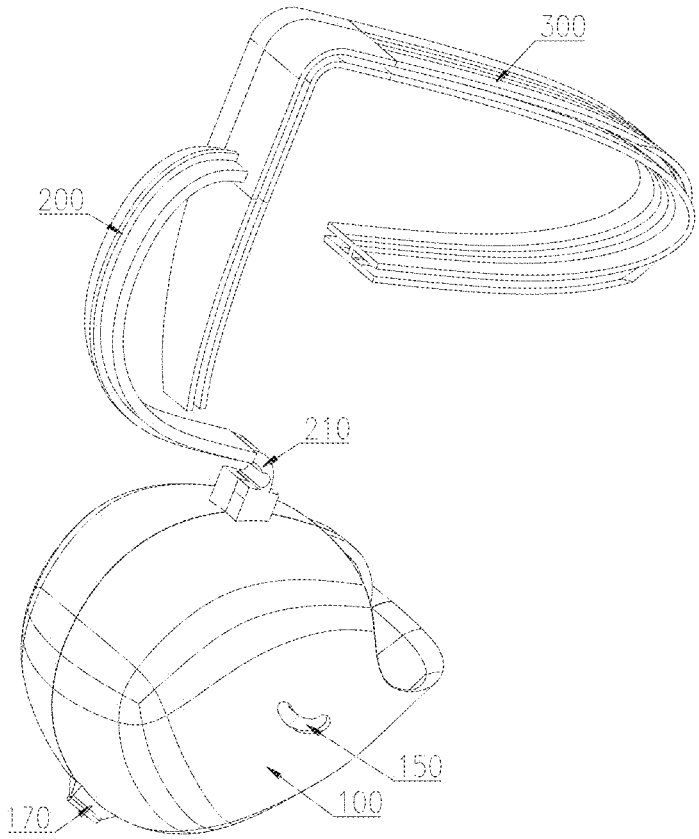
FIG. 7 is a structural view of the engaged housing according to a sixth embodiment according to the present invention.

As shown in FIG. 7, the sixth embodiment differs from the fifth embodiment only in that: In order to reduce assembly steps in use for the user, the housing hook 200 and the housing 100 are arranged in a flexible connection, which reduces the disassembly and assembly steps and is convenient for the user to use.

Specifically, as shown in FIG. 9, the whole housing hook 200 has an inverted hook-shaped structure, and includes the end segment 210 fixedly connected to the fitting portion 162 and the arc segment 220 connected with the end segment 210; the flexibility of the arc segment 220 is smaller than that of the end segment 210; the bending direction of the arc segment 220 faces a side away from the vertical plate 310, that is, the arc segment 220 is bent toward the center of the toilet bowl 500, so that the housing 100 can fit the toilet bowl 500 in a corresponding large size. When the toilet bowl 500 has a corresponding small size, the housing hook 200 generates deformation toward the inner wall of the toilet bowl 500 so as to fit more toilets with different models. The end segment 210 is used to hang the housing 100. Since the flexibility of the arc segment 220 is smaller than that of the end segment 210, when water enters the housing 100, the weight of the housing 100 and the toilet cleaner causes that the deformation amount of the end segment 210 is greater than the deformation amount of the arc segment 220, and the housing 100 may also deflects angularly under the action of gravity after the water enters, so that the water inlet 130 fits the inner wall of the toilet bowl 500. Meanwhile, the position of the relative height of the housing 100 does not change greatly, and then the water flowing out of the rim hole 520 of the toilet bowl to smoothly flow in large quantities into the housing 100 along the inner wall of the toilet bowl 500.

As shown in an enlarged view in FIG. 9, the end segment 210 is also provided with a concave area near the fitting portion 162, which is to further increase the flexibility of the end segment 210, so that an adjustment range of the housing 100 under the action of gravity is larger after water enters the housing. The cross section of the arc segment 220 is an inverted T-shaped structure, and the cross section of the end segment 210 is a flat-plate structure. Preferably, the horizontal plate of the T-shaped structure of the arc segment 220 is integrally formed with the end segment 210, and the vertical plate of the T-shaped structure is provided in the arc segment 220, so that the housing hook 200 is simple in structure, more economical in material, and is simple and effective.

In the above six embodiments, the time from the formation of the effective solution to the completion of dripping is controlled by controlling the size of the gap after the engagement of the left housing and the right housing, which means the release period is extended, so that most of the solution remains in the toilet, the content of effective substances of the toilet cleaner in the bowl is ensured, the waste is reduced, and the using effect is improved. Secondly, as to the bowl hook in the present invention, regardless of the model size of the toilet bowl, appropriate deformation is made to the corner adapter plate to clamp the bowl upper rim, and the relative positions of the vertical plate and the bowl upper rim do not change, thereby providing a stable hanging foundation for the housing hook. Thirdly, the housing hook has sufficient strength and sufficient deformability. In a case of matching toilets with different models, the housing hook can deform appropriately, so that the water inlet of the housing is close to the rim holes of the bowl, which ensures that the housing can receive a sufficient amount of water.

Embodiment 7

The invention provides an extended-time release method for the toilet cleaner, including the following steps: mixing water with the toilet cleaner to form the initial solution when water enters the bowl; starting release of the initial solution while water level in the bowl returns to normal; and continuing the release of the initial solution until the release is completed, in which a mixed liquid of the initial solution and the water in the bowl is referred to as a primary solution. In the above method, the volume of the initial solution is not less than 10 ml; and the content of the effective ingredients of the toilet cleaner in the primary solution is not less than 2 ppm. Preferably, the volume of the initial solution is 10 to 50 ml.

Preferably, the solubility of the toilet cleaner in the initial solution in water at 25° C. is not more than 10 g/L; or the solubility of the toilet cleaner in the initial solution in water at 20° C. is not more than 5 g/L.

In the present invention, the toilet cleaner contains a chemical substance having the structural formula (1):

(1)

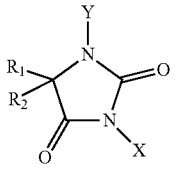

in which $R_1$ and $R_2$ are each independently selected from any one of $C_1$-$C_6$ alkyl substituents and hydrogen, and at least one of $R_1$ and $R_2$ should be a $C_1$-$C_6$ alkyl; X and Y are each independently selected from any one of bromine, chlorine and hydrogen, and at least one of X and Y should be a halogen element.

Specifically, the chemical substance of the toilet cleaner is selected from: any one of 1,3 dichloro-5,5-dimethylhydantoin,
1,3 dibrom-5,5-dimethylhydantoin,
1-bromo-3-chloro-5,5-dimethylhydantoin,
1-chloro-3-bromo-5,5-dimethylhydantoin,
1,3-dichloro-5-methyl-5-ethylhydantoin,
1,3-dibromo-5-methyl-5-ethylhydantoin,
1-bromo-3-chloro-5-methyl-5-ethylhydantoin,
1-chloro-3-bromo-5-methyl-5-ethylhydantoin,
1,3-dibromo-5-methyl-5-isobutylhydantoin, and
1,3-dibromo-5-methyl-5-propylhydantoin,
or a mixture of two or more.

In order to verify the toilet cleaners with different chemical substances in the present invention, the toilet cleaning method and device in the present invention are used to obtain the final content of the effective substance the toilet cleaner in the bowl, and the inventors tested five different kinds of toilet cleaners that can release effective bleaching ingredients after being dissolved in water. In the actual test, the test data of about 30 days is selected, and is shown in FIG. 20. A test method of available chlorine content in the water of the bowl is as follows: putting the toilet cleaner capable of releasing the effective bleaching ingredients after being dissolved in the water into the packaging bag, and hanging the packaging bag on the bowl upper rim 510, in which the hanging position can ensure that the packaging bag can accumulate water required by the package design for 6 times or 10 times of flush every day at regular intervals; and testing available chlorine content in the primary solution in the water body every time the bowl flushes, in which the data specifically provided is the lowest data values in all data tested in one day. The method adopted by an effective chlorine test is testing the effective chlorine with reference to Chapter 19, Determination of available chlorine in detergents (titration method), Surface Active Agents-Detergents-Testing Methods (GB/T 13173-2008). Due to the fact that the available chlorine content tested in the present invention is low, concentration and sample amount and the like are adjusted relative to the national standard testing method in order to obtain a more accurate testing result.

Specifically, the concentration of sodium thiosulfate in a standard titration solution is $c(Na_2S_2O_3)=0.01$ mol/L; during the test, the sample amount is adjusted according to the available chlorine content in the primary solution, and 60 g to 70 g of the primary solution in the bowl is weighted by a at each flush for testing with an analytical balance after each flush and is recorded as the mass m (to the nearest 0.001 g); in the calculation of results, the available chlorine content is calculated as the mass fraction X, and the value is expressed in ppm. The specific calculation process is as follows:

$$X = \frac{c \times V \times 35.45}{m} \times 1000$$

In which:

c, referring to the concentration of the sodium thiosulfate standard titration solution in mole per liter (mol/L);

V, referring to the volume of the sodium thiosulfate standard titration solution consumed by titration in milliliter (mL);

35.45, referring to the relative atomic mass of chlorine in gram per mole (g/mol); and m, referring to weighed mass of the primary solution for test in gram (g).

An arithmetic average from two parallel determinations is expressed to the first decimal place and taken as the determination result.

It should be noted that the available chlorine content mentioned in this application does not refer to pure available chlorine content. When a sample has available bromine ingredients, the sample also contains the available bromine content. Since it is difficult to distinguish specific proportions of the available chlorine and the available bromine by using the determination method in this experiment, for the experimental data provided in FIG. 20, the available chlorine content in the water body of the bowl is uniformly calculated by the molar mass of chlorine element for the convenience of calculation. From the experimental data in FIG. 20, it can be found that if the available chlorine content is not lower than 2 ppm, the extended-time release method for the toilet cleaner provided by the invention can ensure that the effective substance of the toilet cleaner is continuously released for at least 26 days in the bowl with 6 flushes each day.

In addition, as shown in FIG. 21, the embodiment also provides solubility of toilet cleaners in the initial solution, in which the search result in SciFinder Academic (American Chemical Abstracts Database) are calculated by using Advanced Chemistry Development (ACD/Labs) Software V11.02. It can be seen from the solubility result of data that the solubility of the toilet cleaner used in this technical solution satisfies: the solubility of the toilet cleaner in water at 25° C. is not more than 10 g/L, or the solubility of the toilet cleaner in water at 20° C. is not more than 5 g/L.

The method according to the present invention mainly acts on a flush toilet, more specifically, on the bowl of the flush toilet. The bowl is connected with a sewer through a U-shaped pipe, so that the bowl and the U-shaped pipe tend to have the same composition of water in the end. When using the present embodiment, the toilet cleaner is fixed to an inner wall of the bowl, a flush valve in the tank opens when the user presses a push button on the flush toilet, and the water in the tank enters the bowl via rim holes of the bowl. According to different water flushing directions in the bowl, the flush toilet can be roughly divided into two types, that is, a flush toilet with a vertically flushed bowl or a flush toilet with a horizontally flushed bowl. Regardless of the structure of the flush toilet, water is required to be mixed with the toilet cleaner. Herein, the toilet cleaner can be in solid form or granular form, and packaged in a water-permeable bag, such as a non-woven bag. After the water and the toilet cleaner are mixed, the initial solution can be formed. As the mixing time increases, the content of effective solutes of the toilet cleaner in the initial solution becomes higher and higher; the later the initial solution is released, the higher the solute content is contained in the initial solution. In addition, when it is needed to dissolve the toilet cleaner for a certain period of time to form an initial solution with a higher concentration so as to be released later; this can be achieved by controlling a dissolution rate or a homogeneous mixing rate of the toilet cleaner.

When the initial solution of begins to be released, the water level in the bowl gradually rises and finally returns to normal when water level is in a unflushed state, the water surface in the bowl gradually calms at the same time, and then the initial solution continues the release for a period of time until the release of the initial solution formed by mixing the water and the toilet cleaner is completed. In this stage, a time period between a time point when the water level in the bowl returns to normal and a time point when release of the initial solution is completed is referred to as an extended release time of the toilet cleaner. By controlling the dissolution rate of the toilet cleaner, the time required for dissolution is appropriately extended, so that an amount of solute of the toilet cleaner that is dissolved and washed away at an initial stage of flushing is reduced. Moreover, when the volume of the initial solution is constant, an extended release time causes a higher amount of solute of the toilet cleaner in the initial solution to remain in the bowl. In other words, the solution is prevented from being washed away by the water flow during flushing, so that a large amount of solution remains in the toilet, which reduces waste and ensures the concentration and using effect of the primary solution in the bowl.

In the method, a time for water and toilet cleaner to form the initial solution is defined as t2; a time from starting the release of the initial solution to completing the release is defined as the initial solution outflow time t3. In actual use, the toilet cleaner is stored in a constant-volume container; when water enters the container, the toilet cleaner starts to be dissolved and the release of the initial solution starts. After the water is released, the dissolution ends. When the water and the toilet cleaner form an initial solution to be released immediately, t2=t3.

In the method, a time from the water entering the bowl to the water level in the bowl returning to normal is defined as a toilet flushing time t1; a time from the water level in the bowl returning to normal to the end of the release of the initial solution is defined as an initial solution partially extended release time t4; and t4=t3−t1. In actual use, the toilet cleaner is stored in a constant-volume container, so that the volume of water entering the container is constant. When the water level in the bowl does not return to normal, the concentration of the initial solution flowing into the bowl is low. As the water in the container becomes less and less, the time to dissolve or dilute the toilet cleaner becomes longer and longer, and the concentration of the initial solution flowing into the bowl becomes higher and higher, which can ensure that the final concentration of the initial solution flowing into the bowl is the highest after the water level in the bowl returns to normal, so that most of the effective substances of the toilet cleaner in the bowl remains in the toilet and the waste is reduced.

A time from the water level in the bowl returning to normal to the end of the release of the initial solution is defined as the initial solution partially extended release time t4, then t4≥3 minutes, and/or t4≥t1. After pressing and flushing an existing toilet on the market once, the time, from the water in the tank flowing out to the water surface in the toilet bowl becoming calm, t1=5 to 120 seconds. To increase the content of the initial solution remaining in the toilet bowl, that is, to increase the content of the solute in the primary solution, the initial solution should be released as late as possible after the water surface in the bowl becomes calm. In addition, as the service time of the flush toilet increases, a flush valve in the tank becomes loose and aging. After pressing and flushing the toilet once, the time of the water flowing from the tank into the bowl is significantly extended, that is, the time required for the water surface in the bowl to calm increases. Therefore, the initial solution is set to continue the release for at least another 3 minutes after the flushing is completed. In addition, when water starts to enter the bowl, the water is mixed with the toilet cleaner at the same time to form the initial solution and the release begins, so that a time period between the time when the initial solution starts the release to a starting time of the extended release time t4 is basically the same as the toilet flushing time t1. To ensure that the content of the effective ingredients in the primary solution in the bowl is as much as possible after the release of the initial solution, t4≥t1 is set, that is, the initial solution extended release duration is not less than the toilet flushing time t1. In addition, the concentration of the initial solution becomes higher and higher as the time for dissolving the toilet cleaner increases, so that at least 50% of the initial solution remains in the bowl, that is, at least 50% of the content of the effective substances in the bowl can remain in the primary solution, and thus the solute of the toilet cleaner remains in the bowl as much as possible.

The time from starting the release of the initial solution to completing the release is defined as the initial solution outflow time t3, then t3≤40 minutes and/or t3≥2t1. Since t4=t3−t1, t1=5 to 120 seconds, and t4≥3 minutes, it is preferable that t3=4 to 25 minutes. According to the volume of the initial solution, the release rate of the initial solution is controlled to adjust the time for the initial solution to be completely released. Considering the frequency of use of the toilet in different occasions, the time from the beginning of the release of the initial solution to the end of the release is set to be 4 to 25 minutes, so that the initial solution can be fully released during two consecutive uses of the toilet, the solute contained in the primary solution each time entering the bowl is sufficient, and the using effect of the toilet cleaner is improved. In addition, since t4=t3−t1, t4≥t1, then t3≥2t1, it is ensured that the initial solution extended release duration t4 is not less than the toilet flushing time t1. In addition, the concentration of the initial solution becomes higher and higher as the time for dissolving the toilet cleaner increases, so that at least 50% of the initial solution remains in the bowl, that is, at least 50% of the content of the effective substances in the bowl can remain in the primary solution, and thus the solute of the toilet cleaner remains in the bowl as much as possible.

Preferably, the relationship between the solute content m1 of the primary solution and the solute content m0 of the initial solution is: m1/m0=0.5 to 1.

Flush toilets of different sizes have bowls with different water storage volumes, but the volume of the initial solution formed by the same type of toilet cleaner within the time t2 is constant, that is, the solute content m0 of the initial solution is constant. It is the solute in the primary solution that actually takes effect in the bowl. To ensure the effect of the primary solution in the bowl, a ratio of solute content is used for measurement, that is, m1/m0=0.5 to 1, and preferably, m1/m0=0.5 or 0.6 or 0.7 or 0.8 or 0.9 or 1. Since the bowl is communicated with the U-shaped pipe, a little solute inevitably enters the U-shaped pipe, so that the ratio of m1/m0 is required to be above 0.5. The actual testing steps are as follows: choosing two identical toilets (toilet A and toilet B), cleaning the toilet tanks and the bowls, filling the toilet tanks with water, and the water level in the bowls returning to normal; mounting two identical housings 100 (a and b) on the same position of the two toilets respectively, and the housing 100 located at this position can receive the water flowing into the bowl from the toilet tank; putting the same solid toilet cleaner of the same mass containing cleaning ingredients M into housings a and b respectively; pressing a flush button of the toilet A, using a container to receive all the initial solution released by the housing a when the housing a mounted on the toilet A starts to release the initial solution, and measuring the mass of M in the initial solution received by the container, which is denoted as m0; pressing a flush button of the toilet B, and measuring the mass of M in the primary solution in the bowl, which is denoted as m1, and thus the ratio of m1/m0 is obtained. By means of obtaining a certain volume of the initial solution and the primary solution and using physical and chemical methods, such as drying, the corresponding volume of solute content in the initial solution and the primary solution is obtained, and the total volume of the solute content in the initial solution and the primary solution can be calculated back, that is, an actual ratio of m1 to m0 can be obtained, so as to adjust a mixing ratio of toilet cleaner and water and the release amount of the initial solution. Further, a toilet cleaner 300 is placed in the housing 100, and water is introduced into the housing 100 according to structural characteristics of the flush toilet and mixed with the toilet cleaner 300 to form the initial solution.

As shown in FIG. 22, when the bowl 500 is flushed with vertical water flows and no water enters the housing 100, the toilet cleaner 300 is located at the bottom within the housing 100 under the effect of self-weight. As shown by the arrow in FIG. 22, the water is diverted to move obliquely downwards and diverted from the upper portion of the housing 100 to dissolve or dilute the toilet cleaner 300. As the amount of water entering the housing 100 increases, the housing 100 is filled with water while the toilet cleaner 300 either floats in the housing 100 or continues to be located at the bottom within the housing 100, and eventually the formed initial solution flows out of a drain hole at the bottom of the housing 100.

When the bowl 500 is flushed with vertical water flows, that is, the water from the flush toilet tank into the bowl 500 flows downward along the inner wall of the bowl 500. Since the water flows downward along the inner wall, an water inlet of the housing 100 is provided on the upper portion and faces the inner wall of the bowl 500, the water flow is diverted downward from the inner wall into the housing 100 leaning on the inner wall, so that the water is mixed with the toilet cleaner 300 at the bottom within the housing 100 to dissolve or dilute the toilet cleaner 300, and the formed initial solution flows out of the bottom of the housing 100. In this process, by providing a slender diversion tube or opening a long and narrow water outlet channel at the bottom of the housing 100, the initial solution is slowly released under the action of liquid tension, so that the effect of time extension is achieved.

Figure 23:
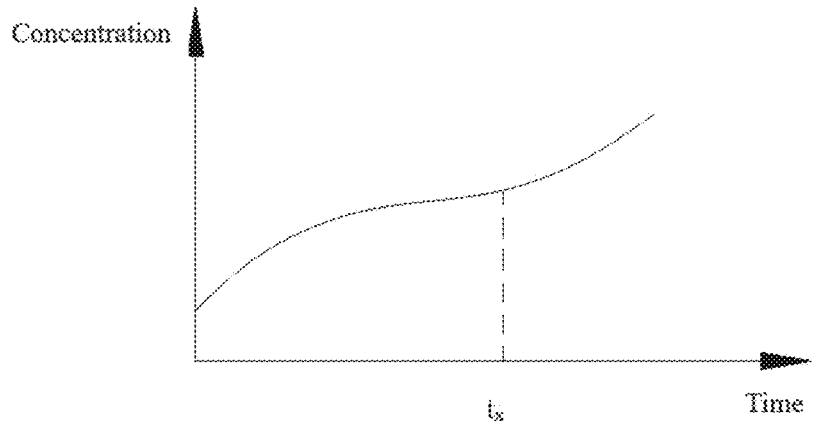
FIG. 23 is a graph showing change of concentration of an initial solution in the housing in the seventh embodiment.

As shown in FIG. 23, during a time between a time point when the volume of the initial solution in the housing reaches the maximum and a time point when the release of the initial solution ends, the concentration or solute content of the initial solution gradually increases. Alternatively, during the time between the time point when the volume of the initial solution in the housing reaches the maximum and the time point when the release of the initial solution ends, the concentration or solute content of the primary solution gradually increases.

The toilet cleaner in the housing is in a dry state before water enters the housing for the first time, and the concentration of the solution in the housing is zero at an instant when water enters the housing; the solid or granular toilet cleaner in the housing is in a wet state before water enters the housing for the second time or more, some initial solution from the last time remains in the housing, and at this time, the concentration of the solution in the housing has a certain initial value. When water gradually enters the housing, the water gradually dissolves and dilutes the toilet cleaner to form the initial solution, and then the initial solution is released from the housing. During a time between an instant when water enters the housing and an instant time point tx when the initial solution starts to be released, an overall trend of the concentration of the initial solution gradually increases.

When the water in the flush toilet just enters the housing, due to the fact that the toilet cleaner is solid with a certain weight and placed at the bottom of the housing, when the buoyancy generated by the amount of water entering the housing is smaller than the self-weight of the toilet cleaner, the toilet cleaner blocks the outlet of the housing and gradually dissolves during this period, so that the liquid concentration of the initial solution in the housing gradually increases; when the buoyancy generated by the amount of water entering the housing is larger than the self-weight of the toilet cleaner, the toilet cleaner starts to leave the outlet of the housing while the water enters the housing continuously, so that the liquid concentration of the initial solution in the housing gradually decreases during this period; finally, when no more water enters the housing, due to the fact that the amount of water flowing out of the bottom in the initial solution is much smaller than an injected amount of water in the housing, the toilet cleaner continues to be dissolved in the water in the housing at this time while the concentration of the initial solution flowing out of the bottom of the housing starts to increase again. Therefore, the concentration variation of the initial solution in the housing is from increase to decrease and is back to increase again. In an actual experimental process, the toilet cleaner is placed in the housing, an appropriate amount of liquid flowing out of the housing is collected at regular intervals, and the effective content of the toilet cleaner in the liquid can be measured.

Figure 24:
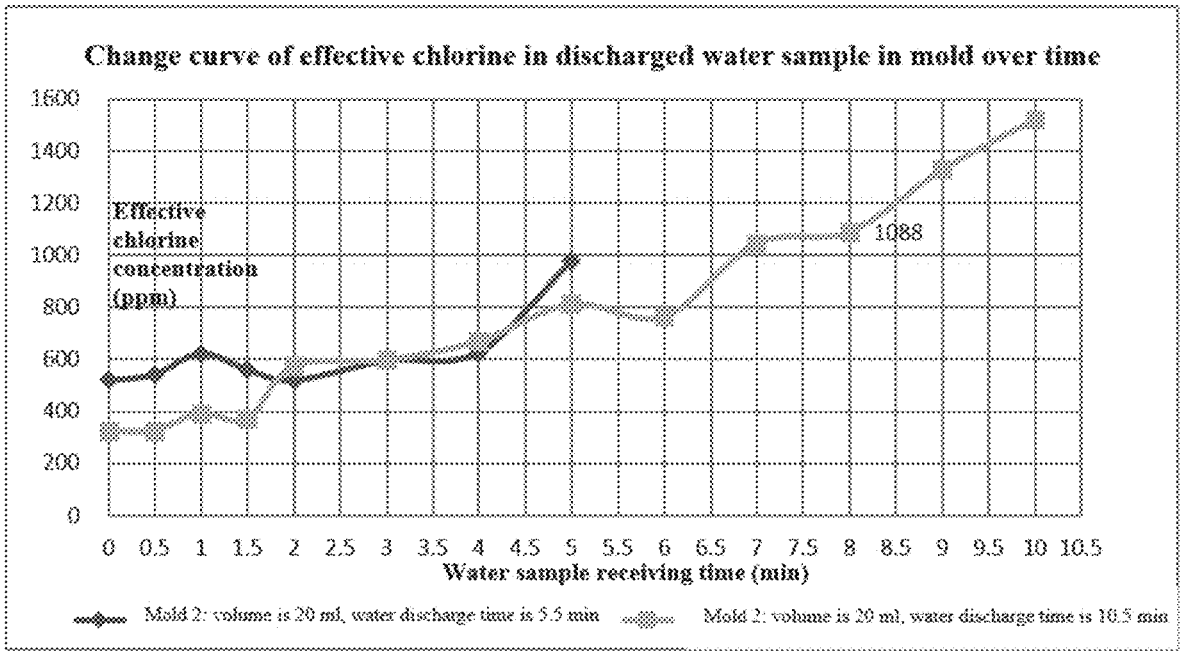
FIG. 24 is a curve showing that effective substances of the toilet cleaner in the initial solution in the housing change over time in the seventh embodiment.

In the present embodiment, as shown by the diamond-shaped dark line in FIG. 24, 4 g of the toilet cleaner sample two as shown in FIG. 20 was weighed into a water-permeable packaging bag; placing the packaging bag samples into a housing 100 of mold 1 respectively after being sealed, in which the volume of the housing 100 is 20 mL, and the time interval for measuring the water discharge of the housing is 5.5 min; counting the time immediately when adding 20 mL of tap water to the housing 100, and collecting a proper amount of liquid discharged from the housing 100 at a certain time interval to test the solute content in the toilet cleaner, and obtaining the results as follows:

| Water discharge time/min | Effective chlorine concentration of the discharged water sample/ppm |
|---|---|
| 0 | 520 |
| 0.5 | 542 |
| 1 | 623 |
| 1.5 | 561 |
| 2 | 520 |
| 3 | 595 |
| 4 | 627 |
| 5 | 977 |

In the present embodiment, as shown by the square grey line in FIG. 24, 4 g of the toilet cleaner sample two as shown in FIG. 20 was weighed into a water-permeable packaging bag; placing the packaging bag samples into a housing 100 of mold 2 respectively after being sealed, in which the volume of the housing 100 is 20 mL, and the time interval for measuring the water discharge of the housing is 10.5 min; counting the time immediately when adding 20 mL of tap water to the housing 100, and collecting a proper amount of liquid discharged from the housing 100 at a certain time interval to test the solute content in the toilet cleaner, and obtaining the results as follows:

| Water discharge time/min | Effective chlorine concentration of the discharged water sample/ppm |
|---|---|
| 0 | 322 |
| 0.5 | 324 |
| 1 | 391 |
| 1.5 | 368 |
| 2 | 574 |
| 3 | 597 |
| 4 | 669 |
| 5 | 810 |
| 6 | 763 |
| 7 | 1045 |
| 8 | 1088 |
| 9 | 1327 |
| 10 | 1520 |

Embodiment 8

The eighth embodiment differs from the seventh embodiment only in that: the effective bleaching component released by the toilet cleaner after being dissolved in water contains a chemical substance having the structural formula (2):

(2)

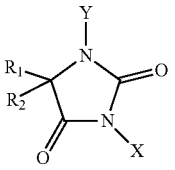

in which $R_1$ and $R_2$ are each independently selected from $C_1$-$C_2$ alkyl substituents, X and Y are each independently selected from any one of bromine, chlorine and hydrogen, and at least one of X and Y should be a halogen element.

The chemical substance of the effective bleaching component released by the toilet cleaner after being dissolved in water is selected from: any one or two of 1,3 dichloro-5,5-dimethylhydantoin,
1,3 dibrom-5,5-dimethylhydantoin,
1-bromo-3-chloro-5,5-dimethylhydantoin,
1-chloro-3-bromo-5,5-dimethylhydantoin,
1,3-dichloro-5-methyl-5-ethylhydantoin,
1,3-dibromo-5-methyl-5-ethylhydantoin,
1-bromo-3-chloro-5-methyl-5-ethylhydantoin, and
1-chloro-3-bromo-5-methyl-5-ethylhydantoin,
or a mixture of two or more.

Figure 25:
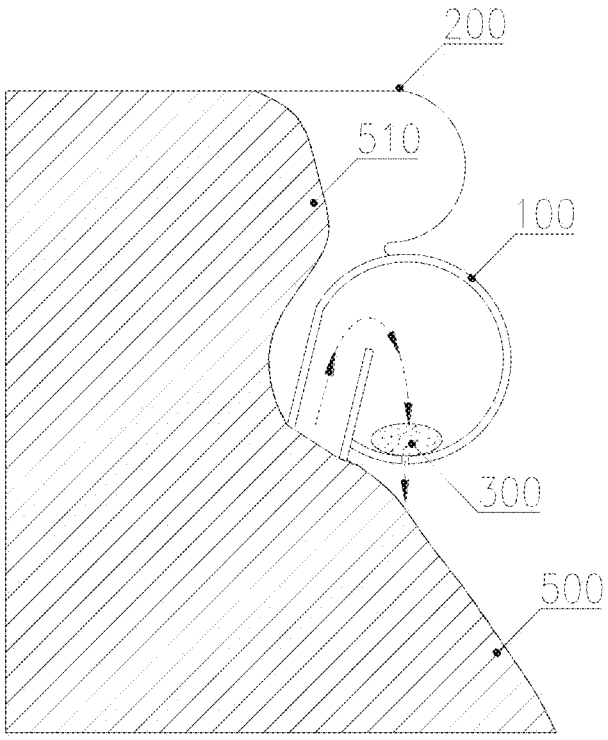
FIG. 25 is a water-flow schematic view when the bowl is flushed with horizontal water flows in the eighth embodiment.

As shown in FIG. 25, when the bowl 500 is flushed with horizontal water flows and no water enters the housing 100, the toilet cleaner 300 is located at the bottom within the housing 100 under the effect of self-weight, the housing 100 is hung on the bowl 500 through the hook 200. As shown by the arrow in FIG. 25, the water is diverted to move obliquely upwards and diverted from the upper portion of the housing 100, so that the water is mixed with the toilet cleaner 300 at the bottom within the housing 100 to dissolve or dilute the toilet cleaner 300, and the formed initial solution flows out of the drain hole at the bottom of the housing 100.

When the bowl 500 is flushed with horizontal water flows, that is, the water in the flush toilet tank enters the bowl 500 from 1 to 2 horizontally arranged water outlets in the rim of the bowl 500. When flushing the toilet, the water may rush out horizontally and form a swirl along the wall of bowl 500 under the action of gravity, which increases the washing power of the water flow on the wall of the bowl 500. Therefore, the horizontally rushed out water flow enters the housing 100 by adopting the obliquely upward diversion method. As the amount of water entering the housing 100 increases, the housing 100 is filled with water while the toilet cleaner 300 either floats in the housing or continues to be located at the bottom within the housing 100, which may eventually form the initial solution to flow out of the bottom of the housing 100 after the toilet cleaner 300 is dissolved or diluted.

Embodiment 9

The ninth embodiment differs from the seventh embodiment in that: an extended-time release method for a toilet cleaner is provided and acts on the bowl 500 of the flush toilet, in which the toilet cleaner is provided in the housing. The method includes the following steps: forming an initial solution with a density ρ1 in the housing 100 by the toilet cleaner 300 before water enters the housing 100; and diluting the initial solution by the water to become a replacement solution with a density ρ2 when water enters the housing 100 again, in which the replacement solution slowly flows out of an opening of the housing 100 and enters the bowl 500; the replacement solution continuing the release until the release ends after the water level of the bowl 500 returns to normal, in which the mixed liquid of the replacement solution and the water in the bowl 500 is referred to as the primary solution; in the above method, the volume of the initial solution contained in the housing 100 is not less than 10 ml; and the content of the effective ingredients of the toilet cleaner in the primary solution is not less than 2 ppm. Preferably, the volume of the initial solution is 10 to 50 ml.

In order to verify the toilet cleaners with different chemical substances in the present invention, the toilet cleaning method and device in the present invention are used to obtain the final content of the effective substance the toilet cleaner in the bowl, and the inventors tested five different kinds of toilet cleaners that can release effective bleaching ingredients after being dissolved in water. From the experimental data in FIG. 20, it can be found that if the available chlorine content is not lower than 2 ppm, the extended-time release method for the toilet cleaner provided by the present invention can ensure that the effective substance of the toilet cleaner is continuously released for at least 27 days in the bowl with 6 flushes each day.

Figure 26:
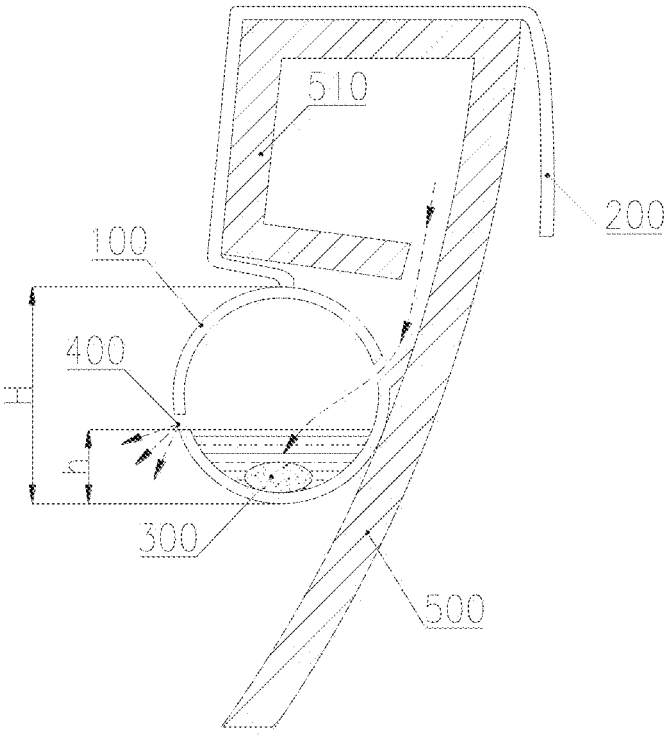
FIG. 26 is a water-flow schematic view when the bowl is flushed with vertical water flows in the ninth embodiment.

The principal principle of the method in the present invention is carried out in a replaced manner. As shown in FIG. 26, the toilet cleaner 300 is first placed within the housing 100 placed in a suitable position of the toilet or the bowl 500, so that water in the flush toilet tank can smoothly enter the housing 100 so as to be mixed with the toilet cleaner 300 and then flow out of the opening of the housing 100. Since water can only flow out via the opening of the housing 100, the water entering the housing 100 may not completely flow out after the user flushes the toilet for the first time, and some water may remain in the housing 100 to partially or completely soak the toilet cleaner 300, so that the toilet agent 300 forms the initial solution in the housing 100, and the water level of the initial solution does not exceed the height of the opening of the housing 100. When the user presses and flushes the toilet for the next time, the water in the flush toilet tank enters the housing 100 again to be mixed with the initial solution while the water level starts to exceed the height of the opening of the housing 100, that is, the replacement solution starts to flow out of the opening of the housing 100 into the bowl 500 at this time, and the concentration of the replacement solution gradually decreases as the water in the flush toilet tank continues to be injected into the bowl 500. However, the effective substance of the toilet cleaner 300 in the replacement solution is gradually released, so that the effective substance of the toilet cleaner 300 contained in the replacement solution slowly reaches the dynamic balance as the toilet cleaner 300 continues to be dissolved in the replacement solution. That is, in the same time period, the effective substance content of the toilet cleaner 300 contained in the replacement solution flowing out of the housing 100 is equal to that of the toilet cleaner 300 for another dissolution in the replacement solution in the housing 100. At this time, the effective substance content of the subsequent toilet cleaner 300 entering the bowl 500 is ensured to be stable, and the effective components in the toilet cleaner 300 is prevented from being washed away by the water flows, so that the effective substance content of the toilet cleaner 300 in the bowl 500 is ensured, most of the solution remains in the toilet, the waste is reduced, and the using effect is improved.

In addition, the whole toilet cleaner 300 is soaked in water in the housing 100, so that the toilet cleaner 300 can be liquid sealed under the water level, volatilization of the volatile components in the toilet cleaner 300 can be avoided, and loss of peculiar smell can also be prevented.

Further, in the method, as shown in FIG. 26, the housing 100 is provided with an opening 400 having a certain height, and when the water level of the replacement solution exceeds the height of the opening 400, the replacement solution flows out of the opening 400 into the bowl 500 until the water level returns to the height of the opening.

Further, in order to avoid excessive residual water in the housing 100 that results in excessive dissolution of the toilet cleaner 300 and causes waste, and avoid that residual water in the housing 100 is too insufficient to facilitate subsequent replacement solution to reach dynamic balance, the opening 400 of the housing 100 is arranged at a position that is ⅓ to ½ of a height direction of the housing 100, that is, as shown in FIG. 1 or FIG. 10, h/H=⅓ to ½, or it is ensured that the residual water volume in the housing 100 is ⅓ to ½ of the total volume of the housing 100.

Further, the toilet cleaner 300 is placed in the housing 100, and water is introduced into the housing 100 according to structural characteristics of the flush toilet to dilute the initial solution.

As shown in FIG. 26, when the bowl 500 is flushed with vertical water flows, the water is diverted to move obliquely downwards and diverted from the upper portion of the housing 100 to dilute the initial solution, and the formed replacement solution flows out of the housing 100.

When the bowl 500 is flushed with vertical water flows, that is, the water from the flush toilet tank into the bowl 500 flows downward along the inner wall of the bowl 500. Since the water flows downward along the inner wall, the water inlet of the housing 100 is provided on the upper portion and faces the inner wall of the bowl 500, the water flow is diverted downward from the inner wall into the housing 100 leaning on the inner wall so as to be mixed with the toilet cleaner 300 at the bottom within the housing 100 to dissolve or dilute the toilet cleaner 300. As the amount of water entering the housing 100 increases, the housing 100 is filled with water while the toilet cleaner 300 either floats in the housing 100 or continues to be located at the bottom within the housing 100, which may eventually form the initial solution. After the user presses and flushes the toilet for the next time, the water enters the housing 100 again to dilute the initial solution so as to form the replacement solution, and the water level of the replacement solution is higher than the opening 400 of the housing 100, so that the replacement solution flows out from the opening 400 of the housing 100 at this time. In this process, by providing a slender diversion tube or opening a long and narrow water outlet channel at the bottom of the housing 100, the solution is slowly released under the action of liquid tension, so that the effect of time extension is achieved.

Figure 27:
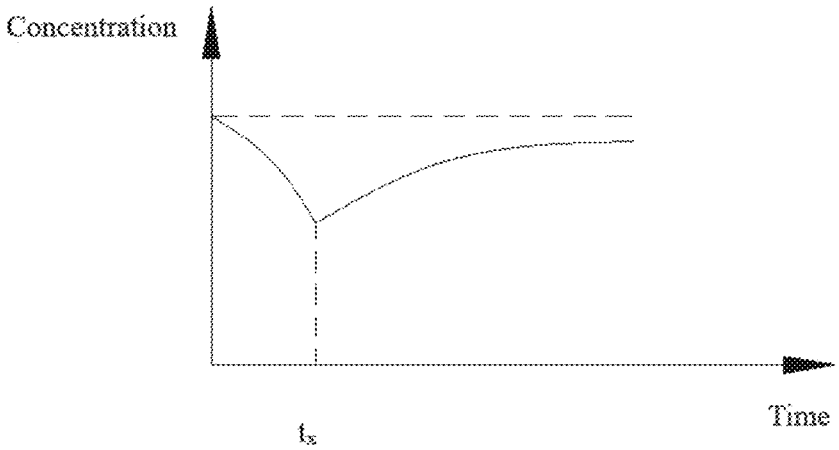
FIG. 27 is a graph showing change of concentration of the initial solution in the housing in the ninth embodiment.

As shown in FIG. 27, the liquid concentration or solute content in the housing is from decrease to increase.

Before water enters the housing again, a certain amount of liquid has already existed in the housing. As the interval between two flushes increases, the solute of the initial solution is at the highest value in the next flushing stage. When water enters the housing again, the initial solution is diluted, and the density of the liquid changes from $\rho 1$ to $\rho 2$. In this stage, as a large amount of flushing water enters the housing, the liquid concentration may decrease at first; as the replacement solution is continuously discharged and the entry amount stops, the liquid concentration in the housing gradually increases; as the toilet cleaner continues to be dissolved in the replacement solution, the effective substances of the toilet cleaner in the replacement solution may slowly reach the dynamic balance.

Embodiment 10

Figure 28:
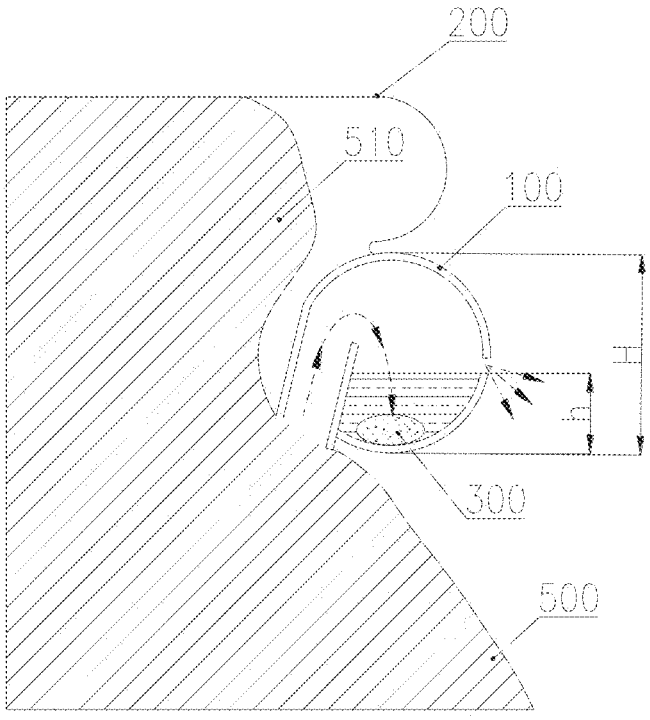
FIG. 28 is a water-flow schematic view when the bowl is flushed with horizontal water flows in the tenth embodiment.

As shown in FIG. 28, the tenth embodiment differs from the ninth embodiment in that: the bowl 500 is flushed with horizontal water flows, the water is diverted to move obliquely upwards and diverted from the upper portion of the housing 100 to dilute the initial solution, and the formed replacement solution flows out of the housing 100.

When the bowl 500 is flushed with horizontal water flows, that is, the water in the flush toilet tank enters the bowl 500 from 1 to 2 horizontally arranged water outlets in the rim of the bowl 500. When flushing the toilet, the water may rush out horizontally and form a swirl along the wall of bowl 500 under the action of gravity, which increases the washing power of the water flow on the wall of the bowl 500. Therefore, the horizontally rushed out water flow enters the housing 100 by adopting the obliquely upward diversion method. As the amount of water entering the housing 100 increases, the housing 100 is filled with water while the toilet cleaner 300 either floats in the housing or continues to be located at the bottom within the housing 100 to eventually form the initial solution. After the user presses and flushes the toilet for the next time, the water enters the housing 100 again to form the initial solution so as to form the replacement solution, and the water level of the replacement solution is higher than the opening 400 of the housing 100, so that the replacement solution flows out from the opening 400 of the housing 100 at this time. In this process, by providing a slender diversion tube or opening a long and narrow water outlet channel at the bottom of the housing 100, the solution is slowly released under the action of liquid tension, so that the effect of time extension is achieved.

Obviously, the above embodiments of the present invention are merely examples for clear illustration of the embodiments in the invention, and are not intended to limit the implementations of the present invention. Any modification, equivalent substitution, improvement, or the like within the spirit and principle of the claims of the invention should be included in the scope of the claims of the invention.

The invention claimed is:

1. An extended-time release method for a toilet cleaner, which acts on inside of a toilet bowl, the method comprising the following steps:

mixing water with the toilet cleaner to form an initial solution when water enters the toilet bowl;

starting release of the initial solution while water level in the toilet bowl returns to normal until the release ends; and continuing the release of the initial solution after the water level in the toilet bowl returns to normal, wherein a mixed liquid of the initial solution and the water in the toilet bowl is defined as a primary solution, a time from the water entering the bowl to the water level in the bowl returning to normal is defined as a toilet flushing time t1;

a time from a beginning of the release of the initial solution to an end of the release is defined as an initial solution outflow time t3; and a time from the water level in the bowl returning to normal to the end of the release of the initial solution is defined as an initial solution partially extended release time t4;

wherein $t4=t3-t1$; and/or wherein $t4 \geq 3$ minutes, and/or $t4 \geq t1$; and/or wherein $t3 \leq 40$ minutes, and/or $t3 \geq 2t1$.

2. The extended-time release method for the toilet cleaner according to claim 1, wherein the toilet cleaner is placed in a housing, the method comprising the following steps:

forming the initial solution with a density $\rho 1$ in the housing by the toilet cleaner before water enters the housing; and diluting the initial solution by the water to become a replacement solution with a density $\rho 2$ when water enters the housing again, wherein the replacement solution slowly flows out of a side opening of the housing and enters the toilet bowl.

3. The extended-time release method for the toilet cleaner according to claim 1, wherein a volume of the initial solution is not less than 10 ml, and a content of effective ingredients of the toilet cleaner in the primary solution is not less than 2 ppm.

4. The extended-time release method for the toilet cleaner according to claim 3, wherein solubility of the toilet cleaner in the initial solution in water at 25° C. is not more than 10 g/L, or the solubility of the toilet cleaner in the initial solution in water at 20° C. is not more than 5 g/L.

5. The extended-time release method for the toilet cleaner according to claim 3, wherein a relationship between a solute content m1 of the primary solution and a solute content m0 of the initial solution is: m1/m0=0.5 to 1.

6. The extended-time release method for the toilet cleaner according to claim 1, wherein t3=4 to 25 minutes.

7. The extended-time release method for the toilet cleaner according claim 1, wherein effective bleaching components released by the toilet cleaner itself or the toilet cleaner after being dissolved in water contains a chemical substance having a structural formula (1):

(1)

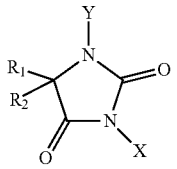

wherein $R_1$ and $R_2$ are each independently selected from any one of $C_1$-$C_6$ alkyl substituents and hydrogen group, and at least one of $R_1$ and $R_2$ is a $C_1$-$C_6$ alkyl; X and Y are each independently selected from any one of bromine, chlorine and hydrogen, and at least one of X and Y is a halogen element.

8. The extended-time release method for the toilet cleaner according to claim 1, wherein effective bleaching components released by the toilet cleaner itself or the toilet cleaner after being dissolved in water contains a chemical substance having a structural formula (2):

(2)

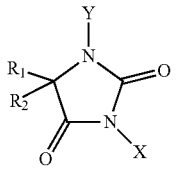

wherein $R_1$ and $R_2$ are each independently selected from $C_1$-$C_2$ alkyl substituents, X and Y are each independently selected from any one of bromine, chlorine and hydrogen, and at least one of X and Y is a halogen element.

9. An extended-time release device for a toilet cleaner, which is suitable for use in a toilet bowl, comprising:

a bowl hook hung on an upper rim of the toilet bowl;

a housing hook connected with the bowl hook; and a housing hung at a bottom of the housing hook, wherein the housing is configured to place the toilet cleaner, an upper portion of the housing is provided with a water inlet, and a lower portion of the housing is provided with a gap for water to flow out; and flexibility of the housing hook is greater than that of the bowl hook.

10. The extended-time release device for the toilet cleaner according to claim 9, wherein the housing includes a left housing and a right housing that are engaged with each other; the left housing and/or the right housing is provided with a protrusion portion at an engagement position, and the protrusion portion leaves a gap for water to flow out when the left housing and the right housing are engaged.

11. The extended-time release device for the toilet cleaner according to claim 9, wherein a limit portion for restricting a movement of the toilet cleaner is provided in the housing.

12. The extended-time release device for the toilet cleaner according to claim 9, wherein the housing hook and the housing are arranged in a rotary connection or a flexible connection.

13. The extended-time release device for the toilet cleaner according to claim 9, wherein the bowl hook includes a vertical plate, a horizontal plate, a corner adapter plate and an inclined plate that are sequentially connected, rigidity of the corner adapter plate is not greater than that of the vertical plate or the horizontal plate.

14. The extended-time release device for the toilet cleaner according to claim 13, wherein flexibility of the vertical plate is arranged to be smaller than that of the inclined plate.

15. The extended-time release device for the toilet cleaner according to claim 9, wherein a bending direction of a connecting end that connects the housing hook with the housing faces rim holes of the toilet bowl.

* * * * *